US012704282B2

(12) United States Patent
Heenehan et al.

(10) Patent No.: US 12,704,282 B2
(45) Date of Patent: Aug. 11, 2026

(54) HEAT PUMP WITH OVERDRIVE STAGE SETTING

(71) Applicant: Trane International Inc., Davidson, NC (US)

(72) Inventors: Taylor Heenehan, Tyler, TX (US); Benjamin Winsett, Bullard, TX (US); Julie Eagle, Whitehouse, TX (US); Mark D. Woodruff, Tyler, TX (US)

(73) Assignee: TRANE INTERNATIONAL INC., Davidson, NC (US)

( * ) Notice: Subject to any disclaimer, the term of this patent is extended or adjusted under 35 U.S.C. 154(b) by 427 days.

(21) Appl. No.: 18/345,205

(22) Filed: Jun. 30, 2023

(65) Prior Publication Data

US 2025/0003618 A1 Jan. 2, 2025

(51) Int. Cl.

| | |
|---|---|
| ***F24F 11/61*** | (2018.01) |
| ***F24F 11/65*** | (2018.01) |
| ***F24F 11/77*** | (2018.01) |
| ***F24F 11/88*** | (2018.01) |
| *F24F 110/12* | (2018.01) |
| *F24F 140/10* | (2018.01) |

(52) U.S. Cl.

CPC ..... *F24F 11/61* (2018.01); *F24F 11/65* (2018.01); *F24F 11/77* (2018.01); *F24F 11/88* (2018.01); *F24F 2110/12* (2018.01); *F24F 2140/10* (2018.01)

(58) Field of Classification Search

CPC .. F24F 11/65; F24F 11/67; F24F 11/77; F24F 11/88; F24F 2110/12

See application file for complete search history.

(56) References Cited

U.S. PATENT DOCUMENTS

| | | | | |
|---|---|---|---|---|
| 3,742,302 A | | 6/1973 | Neil | |
| 4,242,626 A | | 12/1980 | Gross | |
| 4,269,261 A | * | 5/1981 | Kountz | G05D 23/24 62/160 |
| 4,273,540 A | | 6/1981 | Dill | |

(Continued)

FOREIGN PATENT DOCUMENTS

| | | | | |
|---|---|---|---|---|
| CN | 114811836 A | * | 7/2022 | F24F 11/64 |
| CN | 115200156 A | * | 10/2022 | F24F 11/56 |

(Continued)

*Primary Examiner* — Nelson J Nieves

(74) *Attorney, Agent, or Firm* — Womble Bond Dickinson (US) LLP

(57) ABSTRACT

Examples of the present disclosure relate to systems and methods for providing an elevated third-stage of operation to a two-stage compressor of a climate control system. The first low stage and the second high stage are provided with open or closed bypass ports respectively and by operating the two-stage compressor at a rated power setting. The elevated third-stage of operation is provided by operating the two-stage compressor at the high stage with an overdrive power setting. The elevated third-stage may be enabled in heating mode and locked out in cooling mode. The two-stage compressor may be further locked out of the second high stage in cooling mode and an indoor fan may be operated at various speeds to provide additional cooling capacity. Switching between each stage of the two-stage compressor may be controlled by additional control circuitry including a plurality of relays.

17 Claims, 12 Drawing Sheets

(56) References Cited

U.S. PATENT DOCUMENTS 4,364,237 A * 12/1982 Cooper ..... F25B 49/02 62/181
4,566,289 A * 1/1986 Iizuka ..... F25B 49/025 318/807
4,603,556 A * 8/1986 Suefuji ..... F24F 11/86 62/228.4
4,622,827 A * 11/1986 Jabami ..... F25B 49/025 62/158
4,718,247 A * 1/1988 Kobayashi ..... G05D 23/24 62/158
5,689,141 A 11/1997 Kikkawa et al.
5,809,793 A 9/1998 Shutt et al.
5,996,364 A 12/1999 Lifson et al.
6,172,476 B1 * 1/2001 Tolbert, Jr. ..... H02P 25/04 62/228.4
6,801,013 B2 * 10/2004 Woodward ..... H02P 25/04 318/729
7,272,302 B2 * 9/2007 Woodward ..... H02P 25/04 388/801
7,644,869 B2 * 1/2010 Hoglund ..... G05D 23/1902 236/46 C
7,841,837 B2 * 11/2010 Chen ..... H05K 7/20209 318/473
7,856,834 B2 12/2010 Haley
8,011,199 B1 9/2011 Chen et al.
8,037,713 B2 10/2011 Haley et al.
8,790,089 B2 7/2014 Moody et al.
8,964,338 B2 * 2/2015 Wallis ..... F04C 28/28 318/434
9,599,118 B2 * 3/2017 Zhou ..... F04D 27/0269
10,209,751 B2 2/2019 Zikes et al.
10,465,937 B2 * 11/2019 Berg ..... F25B 49/022
10,495,351 B2 12/2019 Kuroda
10,670,296 B2 6/2020 Popli et al.
10,801,497 B2 10/2020 Nakamoto et al.
11,131,491 B1 9/2021 Patel et al.
11,585,581 B2 2/2023 Patel et al.
2005/0086957 A1 4/2005 Lifson et al.
2011/0192176 A1 * 8/2011 Kim ..... F25B 13/00 62/115
2013/0153197 A1 * 6/2013 Havard, Jr. ..... F25B 49/02 236/49.3
2016/0197566 A1 7/2016 Alvey et al.
2018/0292102 A1 * 10/2018 Mowris ..... F24F 11/46
2019/0049130 A1 * 2/2019 Berg ..... F25B 49/022
2019/0178517 A1 * 6/2019 Lau ..... G05B 19/0426
2022/0345068 A1 10/2022 Tischler et al.
2023/0243544 A1 * 8/2023 Hjortland ..... F25B 49/022 62/160

FOREIGN PATENT DOCUMENTS

EP 1 983 275 A1 10/2009
GB 2059646 A * 4/1981 ..... F24F 11/86
GB 2096363 A * 10/1982 ..... G05D 23/20
GB 2458901 A * 10/2009 ..... F25B 30/02
WO WO-2025001799 A1 * 1/2025 ..... F24F 11/46

* cited by examiner

HEAT PUMP WITH OVERDRIVE STAGE SETTING

TECHNOLOGICAL FIELD

The present disclosure relates generally to systems and methods for increasing the power frequency to a compressor of a climate control system and operating the compressor at the increased power frequency to over-speed the compressor.

BACKGROUND

Various climate control systems exist, and several of these systems are able to provide both heating and cooling. These systems use refrigerant circuits to transport thermal energy between components of the system. Each of these designs offer various advantages, and typically provide for conditioning over a given temperature range. A common form of these systems, often referred to as a heat pump, uses a reversible refrigerant circuit that moves thermal energy between two or more heat exchangers to provide heating and/or cooling as desired.

The refrigerant circuits of each of these systems is driven by a compressor that pulls in low temperature and pressure vapor and compresses the vapor to push out high temperature and pressure gas. Each of these compressors are rated to operate at a certain power and speed to deliver a rated capacity. Each of these systems is exposed to different environmental conditions that effect performance and place varied demands on the compressor to deliver heating or cooling capacity within a rated operating range. Operating in very low temperature environments can push the compressor to the upper limits of its rated heating capacity. These types of environments and limited operating ranges can lead to inadequate heating capacity and inefficient system performance. Increasing the operating range of a compressor to efficiently encompass very low temperature environments, however, can be challenging.

Some systems seek to improve heat pump performance by adding larger compressors, potentially with variable drive systems. These systems, however, may be oversized for most operations, which may result in poor performance, excess costs, larger footprint, and/or other issues. As a result, there exists an opportunity for an active approach to increase the operating performance of fixed stage compressors down into lower temperature ranges.

BRIEF SUMMARY

The present disclosure includes, without limitation, the following examples.

Some example implementations include a climate control system comprising: a compressor including one or more stages, the compressor configured to receive a rated power input at a rated frequency; and control circuitry including electronic circuitry coupled to the compressor and providing a power supply to the compressor, the control circuitry configured to: receive a signal indicative of an operating mode of the climate control systems, the operating mode being one of either a heating mode or a cooling mode, and control the power supply to the compressor, wherein in the cooling mode the power supply provided to the compressor is at the rated power input and the rated frequency, wherein in heating mode during a normal power setting the power supply provided to the compressor is at the rated power input and the rated frequency, and wherein in the heating mode during an overdrive power setting the power supply provided to the compressor is at a modified power input and an increased frequency, wherein the overdrive power setting drives the compressor over a rated speed level.

Further example implementations may include a method of controlling communication between a non-communicating thermostat and a compressor of a climate control system with a switching circuitry to provide a third heating mode: receiving a Y2 indication from the non-communicating thermostat at a first relay, the Y2 indication representative of a request for operation in a high stage of the compressor, the first relay being a normally-open single-pole-single-throw; initiating a first timer upon receipt of the Y2 indication at the first relay, wherein the first timer is a delay-on-make timer of the first relay; receiving a line power from a power supply at the first relay, the line power being at a rated power input and a rated frequency; automatically closing the first relay upon termination of the first timer, wherein the closing of the first relay causes the line power to be provided from the first relay to a second relay through a third relay, the second relay being another normally-open single-pole-single-throw, the third relay being a normally-closed single-pole-single-throw; receiving a threshold condition from a sensor at the second relay, the threshold condition representative of one of at least a suction pressure and an ambient outdoor temperature; initiating a second timer upon receipt of the threshold condition at the second relay, wherein the second timer is a delay-on-make timer of the second relay; automatically closing the second relay upon termination of the second timer, wherein the closing of the second relay causes the line power to be provided from the second relay to an overdrive circuitry, wherein the overdrive circuitry is configured to receive the line power at the rated power input and the rated frequency and modify the frequency of the line power to output a modified power input and an increased frequency to the compressor; and providing the modified power input and the increased frequency to the compressor.

Further example implementations may include a method of controlling a compressor of a climate control system, the compressor including one or more stages and configured to receive a rated power input at a rated frequency, the method comprising: receiving a signal indicative of an operating mode of the climate control system, the operating mode being one of either a heating mode or a cooling mode; controlling a power supply to the compressor; providing the power supply to the compressor at the rated power input and the rated frequency when the signal indicates the climate control system is operating in the cooling mode; providing the power supply to the compressor at the rated power input and the rated frequency when the signal indicates the climate control system is operating in the heating mode and the compressor is operating at a normal power setting; and providing the power supply to the compressor at a modified power input and an increased frequency when the signal indicates the climate control system is operating in the heating mode and the compressor is operating at an overdrive power setting, wherein the overdrive power setting drives the compressor over a rated speed level.

These and other features, aspects, and advantages of the disclosure will be apparent from a reading of the following detailed description together with the accompanying drawings, which are briefly described below. The disclosure includes any combination of two, three, four, or more of the above-noted embodiments, examples, or implementations as well as combinations of any two, three, four, or more features or elements set forth in this disclosure, regardless of whether such features or elements are expressly combined in a specific example description herein. This disclosure is intended to be read holistically such that any separable features or elements of the disclosed disclosure, in any of its various aspects, embodiments, examples, or implementations, should be viewed as intended to be combinable unless the context clearly dictates otherwise.

BRIEF DESCRIPTION OF THE FIGURE(S)

In order to assist the understanding of aspects of the disclosure, reference will now be made to the appended drawings, which are not necessarily drawn to scale. The drawings are provided by way of example to assist in the understanding of aspects of the disclosure, and should not be construed as limiting the disclosure.

Figure 5A:
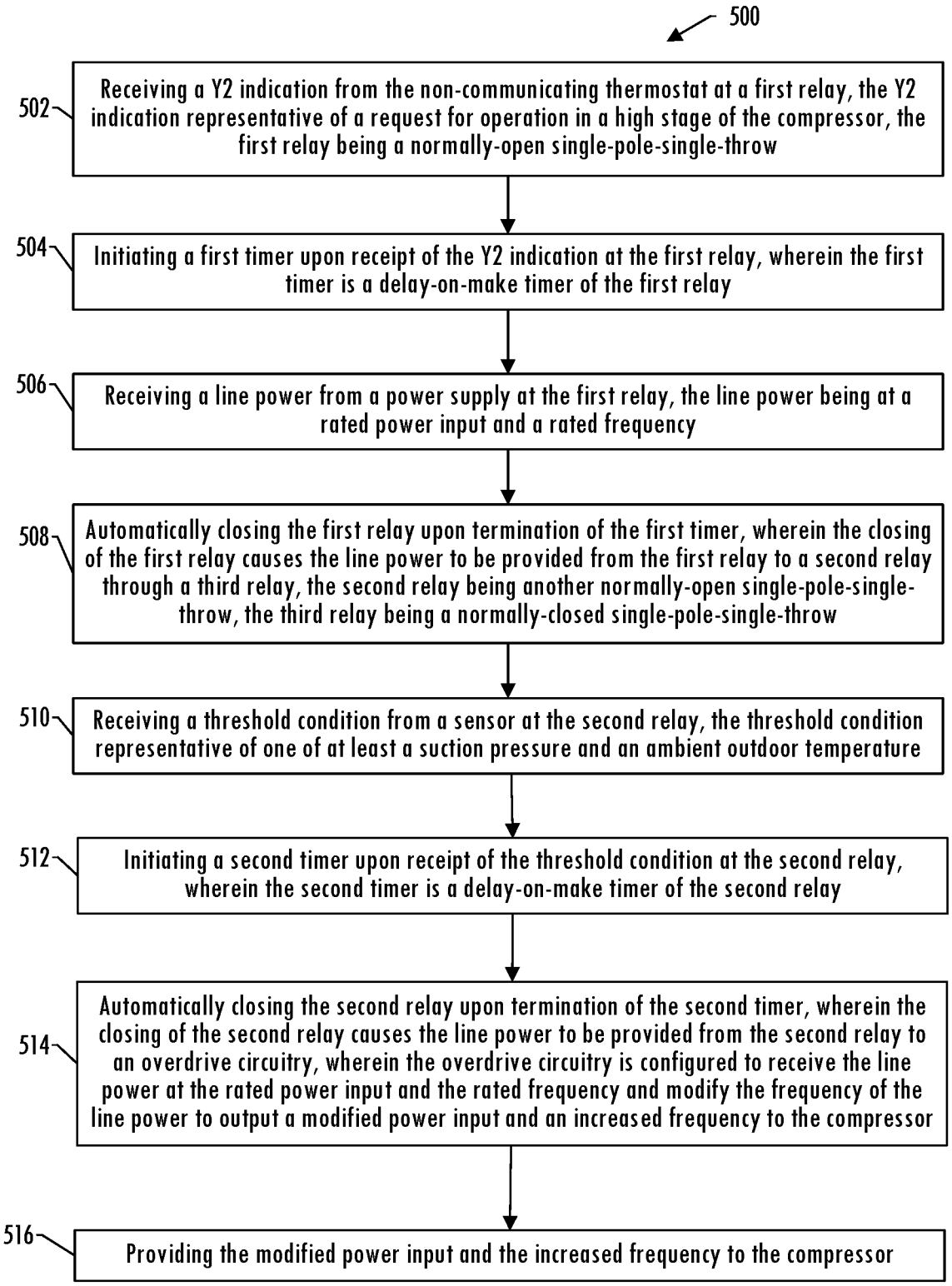
Figure 5B:
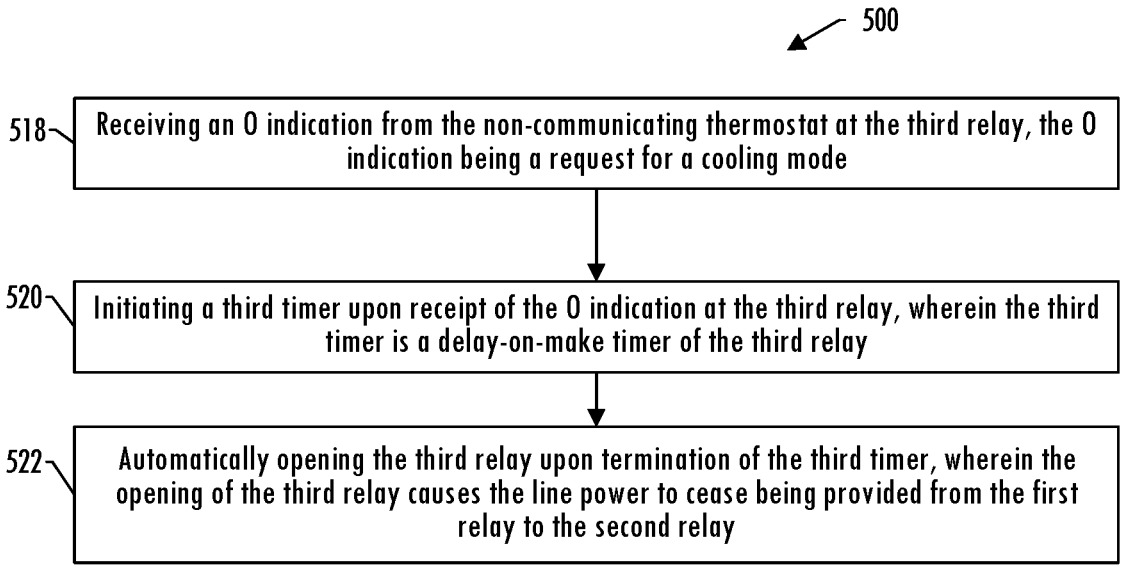
Figure 5C:
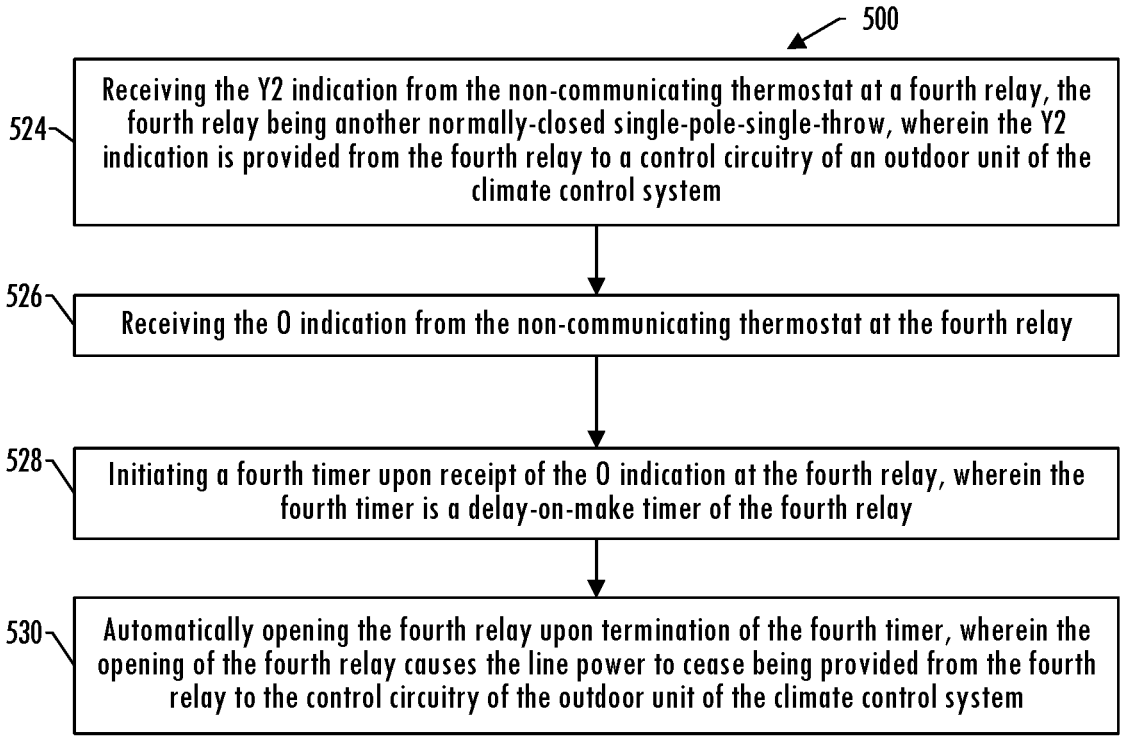
Figure 6:
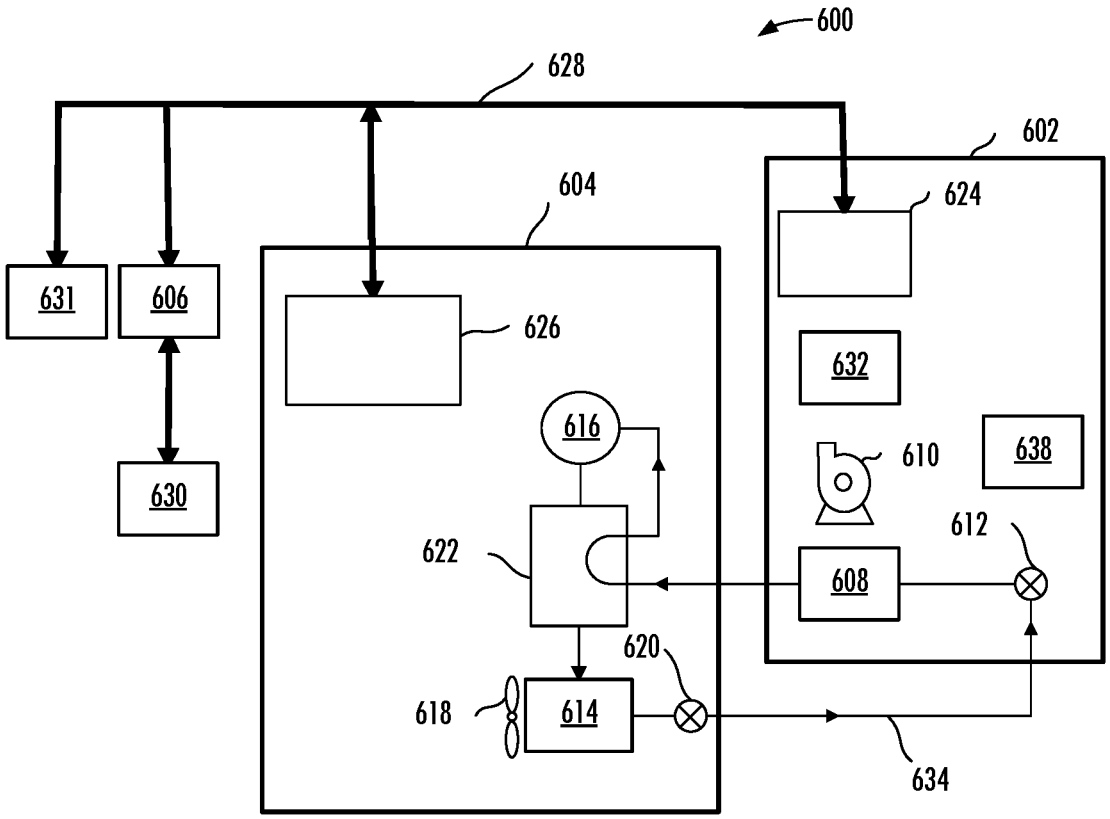
Figure 7:
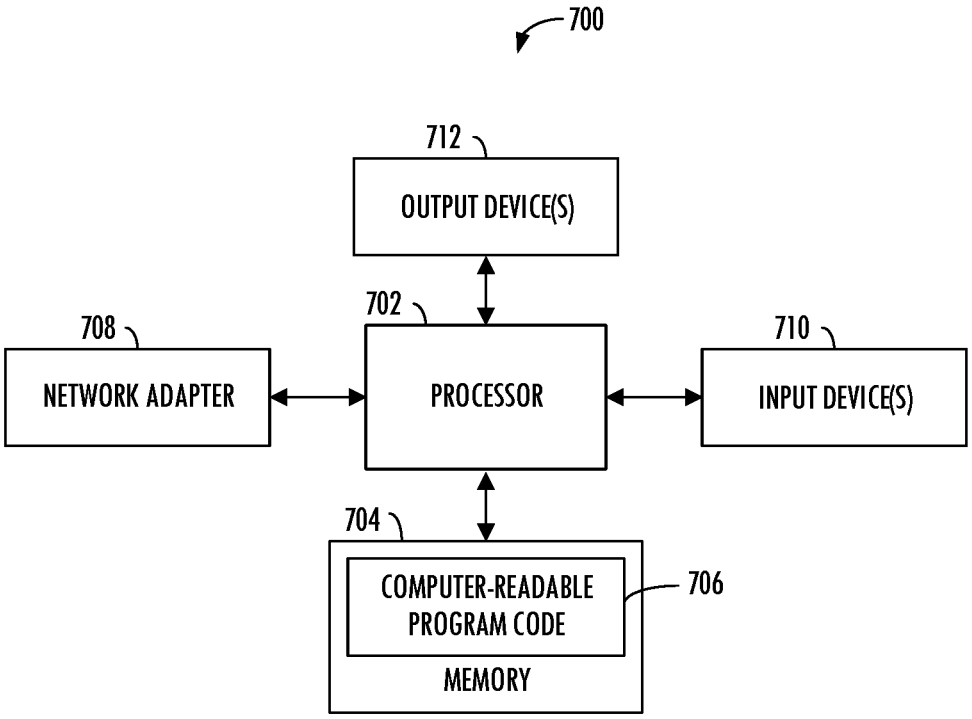

FIGS. 3A, 3B, 3C, and 3D illustrate schematic diagrams of a two-stage compressor, according to some example implementations of the present disclosure;

FIGS. 4A, 4B, 4C, and 4D provide example flow charts for operating climate control systems with electronic circuitry, according to some example implementations of the present disclosure;

FIGS. 5A, 5B, and 5C provide example flow charts for switching power inputs of climate control systems with electronic circuitry, according to some example implementations of the present disclosure;

FIG. 6 illustrates a schematic diagram of a climate control system, according to some example implementations of the present disclosure; and FIG. 7 illustrates control circuitry, according to some example implementations of the present disclosure.

DETAILED DESCRIPTION

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the embodiments, examples, or implementations set forth herein; rather, these example embodiments, examples, or implementations are provided so that this disclosure will be thorough and complete, and will fully convey the scope of the disclosure to those skilled in the art.

For example, unless specified otherwise or clear from context, references to first, second or the like should not be construed to imply a particular order. A feature described as being above another feature (unless specified otherwise or clear from context) may instead be below, and vice versa; and similarly, features described as being to the left of another feature may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise, or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Like reference numerals refer to like elements throughout.

As used herein, the terms "bottom," "top," "upper," "lower," "upward," "downward," "rightward," "leftward," "interior," "exterior," and/or similar terms are used for ease of explanation and refer generally to the position of certain components or portions of the components of embodiments, examples, or implementations of the described disclosure in the installed configuration (e.g., in an operational configuration). It is understood that such terms are not used in any absolute sense.

Example implementations of the present disclosure relate to systems and methods for increasing the deliverable heating capacity of a two-stage compressor at low outdoor ambient temperature ranges, e.g., below freezing, by providing an elevated third-stage with increased heating capacity. In some examples, an elevated third-stage may be provided by the two-stage compressor by over-speeding the compressor's motor. This may be accomplished by operating the motor beyond its rated power input in order to overdrive the compressor and operate the compressor beyond its rated speed. For context, the two-stage compressor may operate in two distinct fixed mechanical stages with a single rated line power input, e.g., a low stage to deliver partial capacity and a high stage to deliver rated capacity. The elevated third-stage may then be provided by increasing the input power frequency to the motor that drives the compressor. By increasing the input power frequency beyond its rated line power frequency, the motor may overdrive the compressor beyond its rated speed and thereby elevate the compressor's delivered capacity beyond the rated capacity of the high stage. In some examples, the elevated third-stage may allow the climate control system to provide additional conditioning capacity and/or further improve the overall coefficient of performance (COP) of the system.

Further example implementations of the present disclosure relate to systems and methods for switching between the elevated third-stage and the two lower stages based on system and environmental conditions and/or other factors. For context, overdriving a two-stage compressor beyond its rated line power input may increase strains on the climate control system leading to excess wear and damage if not regulated properly. Therefore, in some examples, the switching from the rated line power input to a modified power input with increased frequency in order to overdrive the compressor may be controlled by switching circuitry. Delay timers may be utilized to provide gradual switching between stages. In some examples, the elevated third-stage may be locked out under certain conditions in order to protect the climate control system and maintain efficient performance. For example, the elevated third-stage may remained locked until the system switches out of a low stage into a high stage in order to prevent abrupt switches from the low stage to the elevated third-stage.

Before discussing the details of the process for delivering an elevated third-stage from a two-stage compressor, an overview of an example embodiment of a climate control system, and components thereof, is discussed with reference to FIG. 1.

Figure 1:
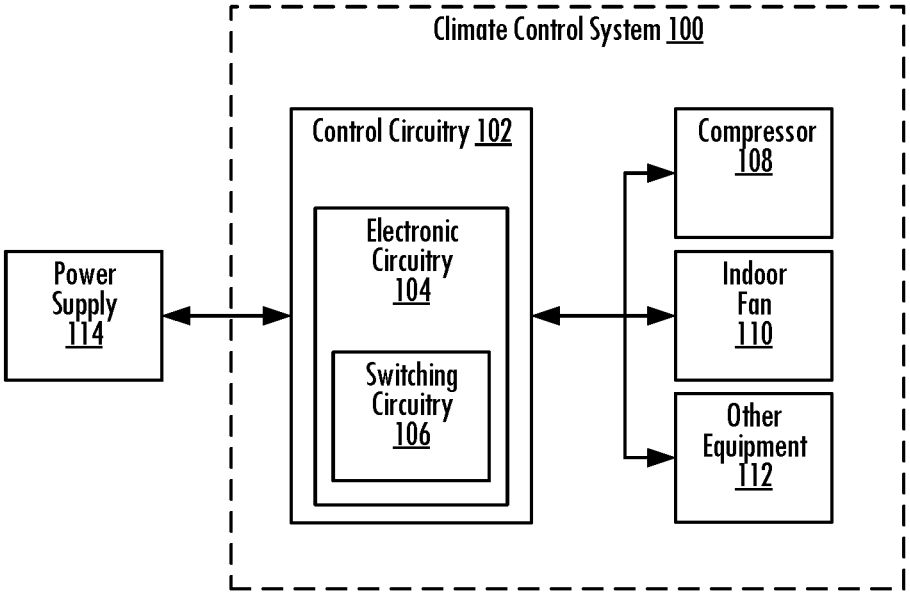
FIG. 1 illustrates a schematic diagram of a climate control system with electronic circuitry, according to some example implementations of the present disclosure.

FIG. 1 shows an example climate control system 100 configured with electronic circuitry 104 for providing an elevated compressor stage to a compressor 108. The climate control system 100 generally includes control circuitry 102, a compressor 108, and an indoor fan 110. Further, as shown in the depicted example, the climate control system 100 may be coupled to a power supply 114 in order to provide line power to the various different components of the climate control system 100. Additionally, the climate control system 100 may include other equipment 112 which will be described in further detail below with respect to at least FIG. 6.

The compressor 108 may be a two-stage compressor that includes a low stage and a high stage. In some examples, the compressor 108 may be a scroll compressor driven by an AC induction motor and may include an internal refrigerant circuit further including an inlet port, bypass ports, and a discharge port. In some examples, the low stage may be configured to provide a partial load of refrigerant to the compression chamber of the compressor 108 and the high stage may be configured to provide a rated load of refrigerant to the compression chamber. The compressor 108, and/or motor thereof, may be configured to receive a rated power input at a rated frequency. In some examples, the rated frequency may be approximately 60 Hz (hertz), 50 Hz, or another frequency. As shown in the depicted example, the compressor 108 may be communicably coupled to the power supply 114 through control circuitry 102, the control circuitry 102 may provide the rated power input at a rated frequency in order to operate the compressor 108, e.g., at the high stage or the low stage. In some examples, the power supply 114 may include AC (alternating current) power at 100-240V (volts) and 50-60 Hz, or the like. In some examples, the compressor 108 may be any example compressor described herein. Example compressors may include, at least in part, one or more of a reciprocating compressor, a scroll compressor, a digital scroll compressor, a screw compressor, a rotary compressor, a centrifugal compressor, a single-stage compressor, a two-stage compressor, a single speed compressor, or the like.

As will be described in more detail below, in some examples, the elevated third-stage may be provided by rated compressor operation at 90 Hz and the high stage may be provided by rated compressor operation at 60 Hz. Further, the low stage may be provided by compressor operation at 60 Hz with compression of a portion of the full refrigerant flow and the remainder rerouted into the compressor shell and/or housing. Moreover, the compressor, and an example of the mechanical operation of at least the low stage and the high stage will be described in further detail below with respect to at least FIGS. 3A-3D.

The control circuitry 102, as shown, may include electronic circuitry 104 which may further include the switching circuitry 106. In some examples, the control circuitry 102 may include one or more of a system controller, indoor controller, outdoor controller, thermostat, or the like. In some examples, the thermostat may include a non-communicating thermostat that provides limited control information to the system controller, indoor controller, and/or outdoor controller through a 24V communication protocol. In some examples, the switching circuitry 106 may include a plurality of mechanical relays, mechanical timers, and/or sensors. In some examples, the switching circuitry 106 may at least partially include digital relays/timers, integrated circuits, software controls, or other non-mechanical digital components. Additionally, the switching circuitry 106 will be described in further detail below with reference to FIGS. 2A-2B. In some examples, the electronic circuitry 104 and/or the switching circuitry 106 may be separate circuits that may be coupled to the control circuitry 102, e.g., as an upgrade for an older model climate control system.

The electronic circuitry 104 may be coupled to the compressor 108 for providing power from the power supply 114 to the compressor 108. In some examples, the electronic circuitry 104 may be configured to provide either a rated power input at a rated frequency or a modified power input at an increased frequency to the compressor 108. In some examples, the increased frequency may be increased from the rated frequency up to approximately 120 Hz, e.g., increased from 60 Hz to approximately 90 Hz. Whether the rated power or the modified power is provided to the compressor 108 may be dictated by the switching circuitry 106. In some examples, power provided by the power supply 114 may be regulated by the control circuitry 102 and further provided to the other equipment 112 and/or the indoor fan 110 of the climate control system 100. It should be understood that the control circuitry 102 may further include an indoor controller, outdoor controller, and/or any other control circuitry and/or aspects thereof described below with respect to at least FIGS. 6-7.

Further, the control circuitry 102 may be configured to provide a signal indicative of the operating mode of the climate control system. For example, the signal may indicate whether the climate control system is operating in heating or cooling mode. Further, in some examples, the control circuitry includes further controls, such as causing the climate control system 100 to operate in one of either a heating mode or a cooling mode. For example, the control circuitry 102 may include an outdoor controller coupled to the outdoor unit to adjust the compressor stage and/or the power, e.g., voltage, current, etc., to the compressor 108. In some examples, the outdoor controller may also be responsible for operating a switch over valve (SOV) and changing the position of the SOV to control operation in either a heating or cooling mode. In some examples, the control circuitry 102 may include a thermostat and/or system controller that may provide control signals to the outdoor controller. In some examples, the outdoor controller may be configured to supersede control signals from the thermostat and/or system controller for reasons of maintaining or improving system efficiency and/or delivering conditioning capacity. Some such examples are described in further detail below.

This may be done through any process, and in these examples, the signal may be provided as part of the process for controlling the operating mode of the climate control system. In some examples, the control circuitry 102 may further dictate in which mode, e.g., heating or cooling, each stage of the compressor 108 may be utilized. Moreover, each stage of the compressor 108 may further define at least a heating and/or cooling mode, e.g., a low cooling mode or a high heating mode. In the depicted example, the control circuitry 102 including the electronic circuitry 104 may control power provided from the power supply 114 to the compressor 108. In some examples, in the cooling mode the power from the power supply 114 may be provided to the compressor at the rated power input and the rated frequency. For example, the control circuitry 102 may cause the climate control system 100 to operate in the cooling mode and the control circuitry 102 may further provide the rated power input and the rated frequency to the compressor 108 while commanding the compressor 108 to maintain operation in the low stage, e.g., thereby providing a low cooling mode.

In some examples, the control circuitry 102 may lock out higher stages of the compressor 108 during cooling mode. In such examples, the compressor 108 may be restricted to its low stage and rated speed level while the climate control system 100 is providing cooling capacity. Additionally, the indoor fan 110 may operate at a plurality of speeds in order for the climate control system 100 to provide various different cooling capacities. For example, the control circuitry 102 may control the indoor fan 110 to operate at a first speed of the plurality of speeds when a first cooling demand is received, e.g., a request for low cooling capacity. The control circuitry 102 may further control the indoor fan 110 to operate at a second speed of the plurality of speeds when a second cooling demand is received, e.g., a request for a high cooling capacity. In some examples, the indoor fan 110 may be a variable speed fan operable at multiple different speed setting and/or across a continuous spectrum.

In some examples, the indoor fan 110 may operate at two discrete airflows, e.g., two discrete speed settings such as a high speed and low speed. In some examples, the two discrete airflows of the indoor fan 110 may be demanded by a signal from a thermostat, and in some examples, the indoor fan may be demanded by a signal from the thermostat separate and distinct from a signal provided by the thermostat to the outdoor controller. Moreover, the two discrete airflows provided by the indoor fan 110 may be separate and distinct from the compressor staging. For example, the thermostat may provide separate and distinct signaling to the indoor fan 110 to switch between a high and low speed setting while the thermostat may provide separate and distinct signaling to the outdoor control to switch the compressor 108 between a high and low stage. In other examples, the indoor fan 110 may operate at one discrete speed. In some examples, the indoor unit of the climate control system may not be driven by the same power circuit as the outdoor unit of the climate control system. Some such examples are described in further detail below.

In such examples, the speed of the indoor fan 110 may be controlled in parallel with the control of the compressor 108, however the speed of the indoor fan 110 may not be regulated proportionally to the speed and/or stage of the compressor 108. Rather the speed of the indoor fan 110 may be uncoupled from the delivered capacity of the compressor 108 and the speed of the indoor fan 110 may be varied while the delivered capacity of the compressor 108 remains constant. In other examples, the speed of the indoor fan 110 may be adjusted proportionally in response to a change in the delivered capacity of the compressor 108.

Further, while the climate control system 100 operates in a heating mode that utilizes a normal power setting, the power from the power supply 114 may be provided to the compressor 108 at the rated power input and the rated frequency. In these examples, the compressor 108 may be a two-stage compressor, and the normal power setting may be used with either the low or high stage of the compressor 108, e.g., to provide multiple heating modes each with a different heating capacity. For example, the control circuitry 102 may cause the compressor 108 to operate in a partial load compressor mode setting, potentially a first compressor mode setting, to provide partial heating capacity, e.g., approximately 65% of the rated compressor capacity. To accomplish this the control circuitry 102 may control power provided from the power supply 114 to the compressor 108 according to the normal power setting in order to provide a rated power input and rated frequency to the compressor 108. Additionally, the control circuitry 102 may control the compressor 108 to maintain operation at the low stage with the rated power input and rated frequency for a time, thereby delivering partial heating capacity.

Furthermore, the control circuitry 102 may cause the compressor 108 to operate in a rated compressor mode setting, potentially a second compressor mode setting, to provide a rated heating capacity, e.g., approximately 100% of the rated compressor capacity. To accomplish this the control circuitry 102 may control power provided from the power supply 114 to the compressor 108 according to the normal power setting in order to provide a rated power input and rated frequency to the compressor 108. Additionally, the control circuitry 102 may control the compressor 108 to maintain operation at the high stage with the rated power input and rated frequency for a time, thereby delivering the rated heating capacity.

In some examples, the climate control system 100 may operate in other heating modes that utilize an overdrive power setting instead of the normal power setting. During operation with the overdrive power setting the power from the power supply 114 may be provided to the compressor 108 at a modified power input and an increased frequency. In such examples, when the overdrive power setting is utilized, the overdrive power setting may drive the compressor 108 to operate over its rated speed level, and thus providing an elevated third-stage in addition to the mechanically distinct low and high stages.

For example, the control circuitry 102 may cause the compressor 108 to operate in an overdrive compressor mode setting, potentially a third compressor mode setting, to provide an elevated heating capacity, e.g., up to approximately 150% of the rated compressor capacity. To accomplish this the control circuitry 102 may control power provided from the power supply 114 to the compressor 108 according to the overdrive power setting in order to provide the modified power input and the increased frequency to the compressor 108. The overdrive power setting including the modified power input and the increased frequency may cause the motor of the compressor 108 to drive the compressor at an elevated speed, e.g., up to approximately 150% of the rated speed of the compressor 108. Further, the control circuitry 102 may control the compressor 108 to maintain operation at the high stage with the modified power input and the increased frequency for a time, thereby delivering elevated heating capacity.

The above compressor mode settings are only examples of the settings that may be applied. It is understood that other compressor mode settings may be utilized, and these settings may also correspond to other operating modes, e.g., cooling mode, defrost mode, dehumidification mode, or the like. In some examples, the compressor 108 may operate in a low stage with a rated frequency, a high stage with a rated frequency, a low stage with an increased frequency, or a high stage with an increased frequency. As described above the rated frequency may be 60 Hz, 50 Hz, or another frequency. Further, the increased frequency may be 90 Hz, 120 Hz, or another frequency.

As discussed above, the systems and methods described herein may utilize different example control circuits that may include electronic circuitry and switching circuitry in order to regulate power to the components of the climate control system. Various different configurations and other non-limiting examples of the control circuitry including electronic circuitry and switching circuitry will now be walked through in further detail below with reference to FIGS. 2A-2B.

Figure 2A:
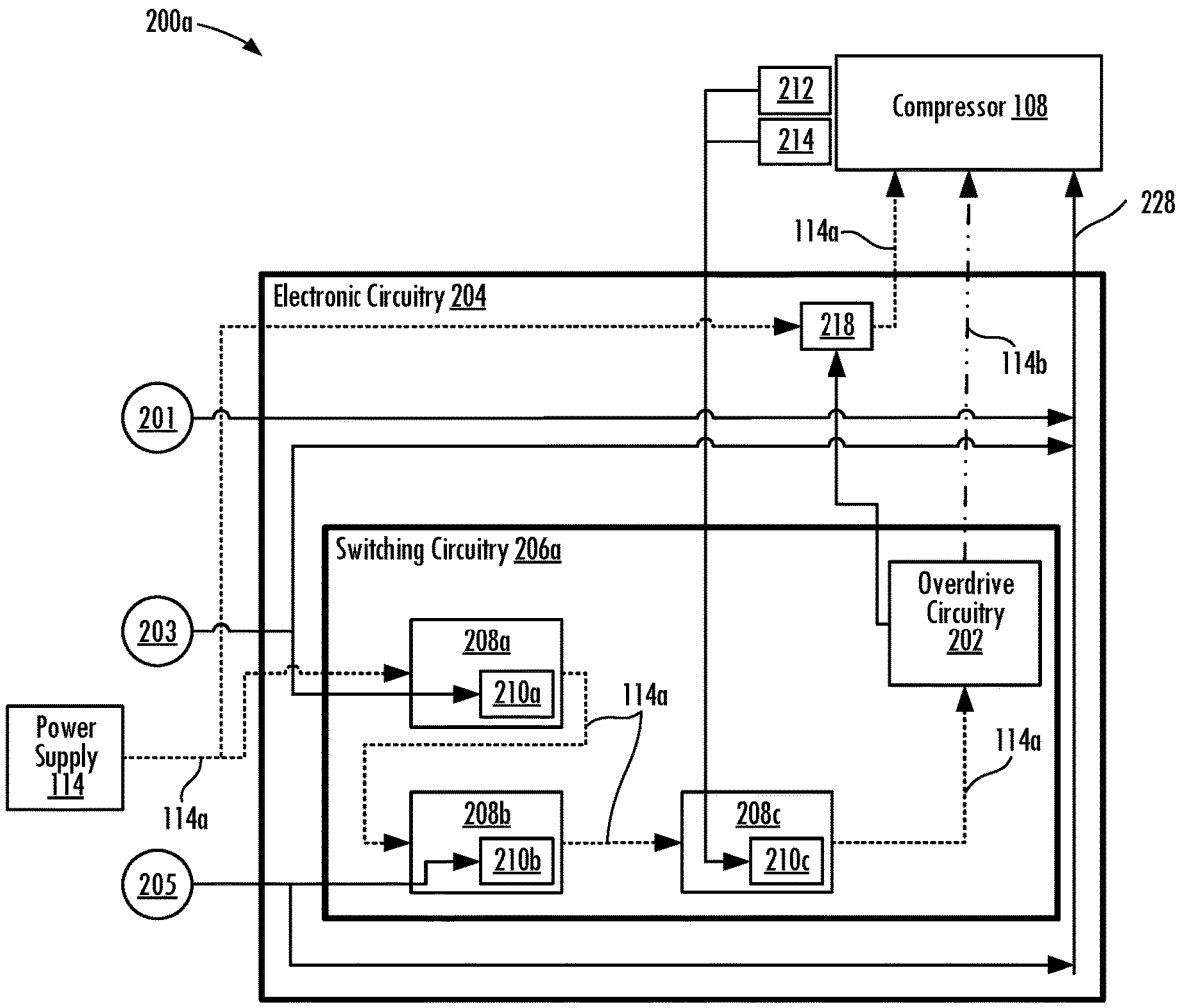
FIGS. 2A and 2B illustrate schematic diagrams of control circuitry with electronic circuitry, according to some example implementations of the present disclosure.
Figure 2B:
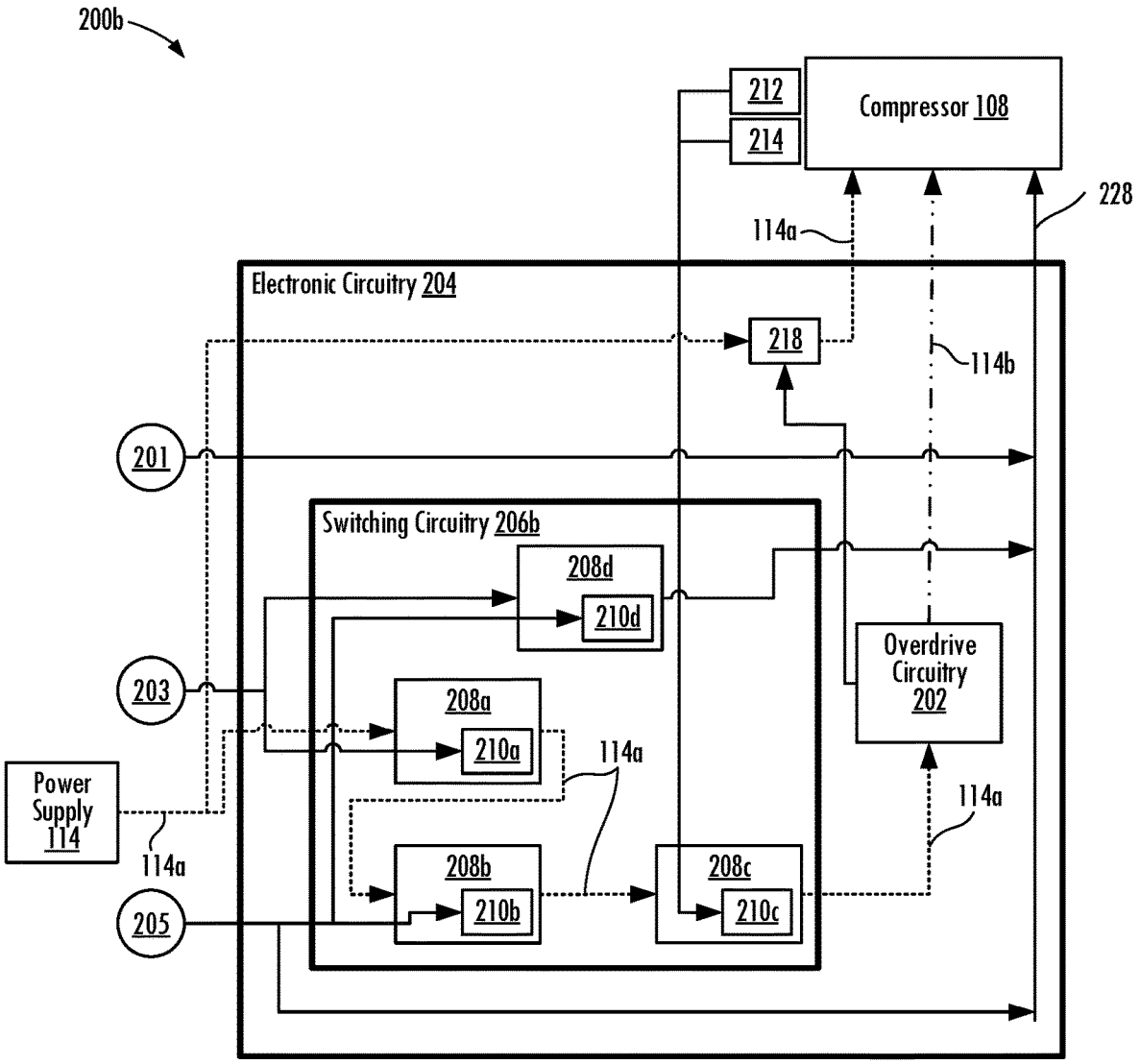

FIGS. 2A-2B show schematic diagrams for example control circuitry 200*a*-200*b* which include an electronic circuitry 204 including a switching circuitry 206*a*-206*b* and an overdrive circuitry 202. The control circuitry 200*a*-200*b* may be the same or similar to the control circuitry 102 of the climate control system 100 discussed herein with reference to FIG. 1. It should also be understood that the control circuitry 200*a*-200*b* may further illustrate additional components (not typically included in the control circuitry, e.g., an indoor controller, outdoor controller, thermostat, etc.) of a climate control system, which may be the same or similar to the climate control system 600 as described herein with reference to FIG. 6.

Further, the examples depicted in FIGS. 2A-2B of the control circuitry 200*a*-200*b* are described with reference to a heating mode but may also be utilized in other modes as described by the present disclosure. For context, the control circuitry 200*a*-200*b* may be included in a controller that is coupled to other controllers such as an outdoor controller coupled with another system controller or thermostat, e.g., 24V non-communicating thermostat, or the like.

Moreover, the following description of the switching circuitry refers to mechanical components, e.g., relays, timers, etc., however it should be appreciated that the switching circuitry may at least partially include digital relays/timers, integrated circuits, software controls, or other non-mechanical digital components as described herein with reference to at least FIG. 7.

Turning now to FIG. 2A, the control circuitry 200*a* as shown generally comprises the electronic circuitry 204, the switching circuitry 206*a*, the overdrive circuitry 202, relay 218, and a plurality of interfaces for transmitting indications and power. The switching circuitry 206*a* as depicted includes a plurality of relays 208*a*-208*c* and relay conditions 210*a*-210*c*. In some examples, each relay of the plurality of relays 208*a*-208*c* may be a mechanical relay including a normally-open relay, normally-closed relay, single-pole-single-throw relay, single-pole-double-throw relay, or the like. In some examples, each relay condition of the plurality of relay conditions 210*a*-210*c* may cause switching of a respective relay based on a delay timer (e.g., a delay-on-make timer or a delay-on-break timer built into the relay) and/or a sensor indication (e.g., an input signal received from a temperature and/or pressure sensor).

The relay 218 may be the same or similar to relays 208*a*-208*c* or the like as described herein. In some examples, the overdrive circuitry 202 may include an integrated circuit, op-amp, oscillator, and/or frequency generator. The overdrive circuitry 202 may be configured to receive a line power at the rated power input and the rated frequency and modify the frequency of the line power to output the modified power input and the increased frequency.

Still with reference to the control circuitry 200*a*, the regulation of power provided to the compressor 108 will now be walked through relative to the various different indications provided to the electronic circuitry 204 as depicted in FIG. 2A.

For context, the electronic circuitry 204 of the control circuitry 200*a* comprises a switching circuitry 206*a* and forms two power circuits from the power supply 114 to the compressor 108. The switching circuitry 206*a* may be configured to switch the electronic circuitry 204 between a first power circuit and a second power circuit. Each power circuit as shown may provide power from the power supply 114 to the compressor 108. However, the first power circuit conveys a line power 114*a* at the rated power input and the rated frequency from the power supply 114 to the compressor 108 by way of relay 218. The second power circuit, in contrast, receives the line power 114*a* at the rated power input and the rated frequency from the power supply 114 and then provides the modified power input 114*b* at the increased frequency to the compressor 108, by way of the switching circuitry 206*a* and the overdrive circuitry 202. In some examples, the switching circuitry and the overdrive circuitry may be a single piece of circuitry as shown in FIG. 2A. For example, the switching circuitry may include in whole, or in part, the overdrive circuitry and the combined circuitry may be included in the outdoor controller of the climate control system. In other examples, the switching circuitry and the overdrive circuitry may be separate and distinct circuitry as shown in FIG. 2B. For example, the switching circuitry may be included in a non-communicating thermostat and the overdrive circuitry may be included in an outdoor controller. In some examples, the indications 201, 203, and 205 (described below) may be provided from another control circuit, e.g., a 24V non-communicating thermostat, to the electronic circuitry 204.

The below walks through the activation of each stage of the compressor 108 in relation to the control circuitry 200*a* in an example where the climate control system is in an idle state and set to a heating mode. It should be understood that while the below description includes reference to mechanical relays and timers still other switching methods may be utilized. In some examples, the control circuitry 200*a* and/or the control circuitry 200*b* may in whole, or in part, replace the below mentioned mechanical relays and/or timers with digital relays and/or timers, integrated circuits, logic boards, software controls, and/or other non-mechanical digital components. For example, the climate control system may utilize a communicating thermostat that communicates with a logic board of the outdoor controller and may initiate the elevated third-stage, e.g., based on the ambient outdoor temperature and/or signals communicated from the communicating thermostat.

Turning first to indication 201, the indication 201 may be representative of a request for a first heating mode to deliver partial heating capacity. In some examples, the indication 201 may be a Y1 indication representative of a request for operation in a low stage of the compressor 108. As shown, the indication 201 passes from the electronic circuitry 204 to the compressor 108, e.g., via an outdoor controller, in order to cause the climate control system to operate in a first heating mode. In response to the indication 201 the electronic circuitry 204 provides the line power 114*a*, e.g., via the first power circuit, at the rated power input and the rated frequency from the power supply 114 to the compressor 108 in order to initiate and/or maintain the low stage operation of the compressor 108.

In some examples, either immediately after receipt of the indication 201 or after a period of time has elapsed, an indication 203 may be received by the electronic circuitry 204. The indication 203 may be representative of a request for a second heating mode to deliver rated heating capacity. In some examples, the indication 203 may be a Y2 indication representative of a request for operation in a high stage of the compressor 108. As shown, the indication 203 passes from the electronic circuitry 204 to the compressor 108 in order to cause the climate control system to operate in a second heating mode. In response to the indication 203 the electronic circuitry 204 provides, or continues to provide, the line power 114*a*, e.g., via the first power circuit, at the rated power input and the rated frequency from the power supply 114 to the compressor 108 in order to initiate and/or maintain the high stage operation of the compressor 108.

Further, as depicted, the indication 203 may be provided to relay 208*a* and initiates the relay condition 210*a*. In the depicted example, relay 208*a* may be a normally-open single-pole-single-throw and the relay condition 210*a* may be a delay-on-make timer of the relay 208*a*. Upon receipt of the indication 203, the delay-on-make timer of the relay

208*a* may initiate and begin counting down until a predefined time period has elapsed, at which time the relay 208*a* switches from its normally-open state to a closed state. In the closed state the relay 208*a* may allow the line power 114*a* to pass to relay 208*b*.

In the depicted example, relay 208*b* may be a normally-closed single-pole-single-throw and the relay condition 210*b* may be a delay-on-make timer of the relay 208*b*. Because the relay 208*b* may be in the closed state initially and no signal has yet been received to actuate the relay condition 210*b*, the relay 208*b* may allow the line power 114*a* to immediately pass further to relay 208*c*.

In the depicted example, relay 208*c* may be a normally-open single-pole-single-throw and the relay condition 210*c* may be a threshold condition based on a sensor indication, e.g., provided from a temperature sensor 212 and/or a pressure sensor 214. In some examples, the temperature sensor 212 and/or the pressure sensor 214 may be coupled to at least the switching circuitry 206*a* proximate the compressor, e.g., in the outdoor unit of the climate control system.

The temperature sensor 212 may monitor an ambient outdoor temperature proximate the compressor and the pressure sensor 214 may monitor a refrigerant circuit suction pressure proximate the inlet port of the compressor 108. The relay condition 210*c* may be a threshold condition that causes the relay 208*c* to switch between the open and closed states based on one or more of an upper or lower ambient outdoor temperature limit or an upper or lower suction pressure limit. For example, the relay 208*c* may close when the ambient outdoor temperature drops below 25° F. and/or the suction pressure drops below 70 psig (pounds per square inch gauge). Additionally, the relay 208*c* may open when the ambient outdoor temperature rises above 40° F. and/or the suction pressure rises above 90 psig. It should be understood that the relay 208*c* of the switching circuitry 206*a* may lock out the overdrive circuitry 202 from receiving the line power 114*a* if the monitored sensor conditions do not meet the threshold limits of the relay condition 210*c*.

In some examples, the sensor indication may be compared to a threshold condition at the relay 208*c*, e.g., the sensor indication may be a voltage that may be proportional to a measured value and the relay 208*c* may require a minimum voltage indication to switch. In some examples, the sensor indication may be compared to a threshold condition at the sensor, e.g., the sensor indication may only be provided to the relay 208*c* when a measured value exceeds the threshold at the sensor. In such examples, the sensor indication may be a binary indication, e.g., present or not present. In some examples, the relay 208*c* may enable or lock out the overdrive circuitry 202 based on the sensor indication and threshold condition comparison, the overdrive circuitry 202 at least partially providing the overdrive power setting as described below.

In order to continue to walk through the illustrated example of FIG. 2A, an example is used where the temperature sensor 212 provides an indication to the relay condition 210*c* representative of an ambient outdoor temperature below 25° F. Upon receipt of the indication from the temperature sensor 212, the relay 208*c* switches from its normally-open state to a closed state which allows the line power 114*a* to pass further to the overdrive circuitry 202. Upon receipt of the line power 114*a* the overdrive circuitry 202 may modify the frequency of the line power 114*a* and output a modified power input 114*b* with an increased frequency. The overdrive circuitry 202 may then provide the modified power input 114*b* to the compressor 108. The overdrive circuitry 202 may also provide an indication to relay 218 to cease providing the line power 114*a* to the compressor 108.

It should be understood that the overdrive circuitry 202 completes the second power circuit of the electronic circuitry 204 by providing the modified power input 114*b* to the compressor 108. Further, the overdrive circuitry 202 may break the first power circuit by causing the relay 218 to open, e.g., cease providing the line power 114*a* to the compressor 108. In some examples, the relay 218 may be a normally-closed relay. Furthermore, the overdrive circuitry 202 may cause the climate control system to operate according to the third heating mode with the overdrive power setting. In some examples, this third heating mode made be in response to a third request for heating, potentially based on the heating demand of the conditioned space, the outdoor temperature, and/or other factors. For example, upon receipt of the modified power input 114*b* and the increased frequency the compressor 108 may initiate the elevated third-stage operation, e.g., provide the elevated heating capacity as described above. In some examples, receiving a third request for heating may comprise one or more of receipt of a request for operation in a low stage, receipt of a request for operation in a high stage, and/or a determination of an expiration of a time period of one or more timers. In some examples, receiving a third request for heating may comprise not receiving a request for operation in a cooling mode, e.g., determining an absence of a demand for cooling. In some examples, a third request for heating may be an internally generated signal by a control circuitry based on one or more conditions, e.g., receipt of an indication, expiration of a timer, or another condition described by the present disclosure.

Still with reference to FIG. 2A, in order to continue to walk through the illustrated example, an example used where the climate control system is operating according to the overdrive power setting and that the required conditions for the overdrive power setting are still maintained, e.g., the ambient outdoor temperature is below 25° F.

Turning to indication 205, the indication 205 may be representative of a request for a cooling mode and/or to provide a defrost mode to the outdoor unit of the climate control system. In some examples, the indication 205 may be an O indication representative of a request for operation in a cooling mode. As shown, the indication 205 passes from the electronic circuitry 204 to the communication bus 228 in order to cause the climate control system to operate in a cooling mode. For example, a switch over valve (SOV) may switch the climate control system from a cooling cycle to a heating cycle or vice versa upon receipt of the indication 205. It should be understood that the indication 205 may be provided through the communication bus 228, or the like, to other components of the climate control system such as the outdoor controller which will be described in further detail below with respect to FIGS. 6-7. In some examples, the communication bus 228 may be the same or substantially similar to the communication bus 628 as described below.

Additionally, as depicted, the indication 205 may be received at relay 208*b*. As described above, the relay 208*b* may be a normally-closed single-pole-single-throw and the relay condition 210*b* may be a delay-on-make timer of the relay 208*b*. Upon receipt of the indication 205, the delay-on-make timer of the relay 208*b* may initiate and begin counting down until a predefined time period has elapsed, at which time the relay 208*b* switches from its normally-closed state to an open state. In the open state the relay 208*b* may prevent the line power 114*a* from passing to relay 208*c*, thereby breaking the second power circuit and locking out the elevated third-stage of the compressor 108. In some examples, the predefined time period of relay 208*b* may be an amount of time required for the compressor 108 to safely winddown from the elevated third-stage to a lower stage, e.g., the low stage and/or the high stage, without causing damage or undue stress on the climate control system. In some examples, switching from a heating mode to a cooling mode may reset the electronic circuitry 204, e.g., close relay 218 to complete the first power circuit and/or reset each of the switching circuitry relays to each of their respective normal states.

Moreover, it should be appreciated that in the depicted examples of FIG. 2A the compressor 108 may operate in either a low stage or a high stage during cooling mode operations of the climate control system. However, the compressor 108 may be locked out from operating in the elevated third-stage during cooling mode operations of the climate control system. Further, the compressor 108 may operate in any of a low stage, a high stage, and an elevated third-stage during heating mode operations of the climate control system when the required conditions of the electronic circuitry 204 are met. In such examples, the climate control system has two cooling capacities and three heating capacities, e.g., each conditioning capacity being defined at least partially by a respective stage of the compressor.

Turning now to the control circuitry 200*b* as shown in FIG. 2B, the electronic circuitry 204 generally receives indications and line power 114*a* (as described above with respect to the control circuitry 200*a*) in order to facilitate various different heating and cooling modes of the climate control system. However, as illustrated in FIG. 2B, the switching circuitry 206*b* is configured with an additional relay 208*d* including relay condition 210*d*, which provides additional functionality as described below.

In the arrangement of FIG. 2B, the indication 203 passes from the electronic circuitry 204 to the compressor 108 by way of the relay 208*d* in order to cause the climate control system to operate in a second heating mode. For context, in contrast, as shown in FIG. 2A and previously described above, the indication 203 passes from the electronic circuitry 204 to the compressor 108, at least partially bypassing the switching circuitry 206*a*, in order to cause the climate control system to operate in a second heating mode. In the depicted examples of FIG. 2B, the relay 208*d* including the relay condition 210*d* may be configured to lockout the high stage of the compressor 108 during operation in a cooling mode. It should be understood that the locking of the high stage of the compressor 108 in cooling mode may be in addition to the locking of the elevated third-stage as described above with respect to FIG. 2A.

Initially assuming that the climate control system is providing a rated heating capacity (previously described above with respect to FIG. 2A), the below will walk through the deactivation of the high stage of the compressor 108 in relation to the control circuitry 200*b* when a request for a cooling mode is received. Turning first to indication 203, the indication 203 may be representative of the request for the second heating mode which causes the compressor 108 to deliver its rated heating capacity. While in the heating mode the indication 203 may pass through the relay 208*d* onto the compressor 108. In the depicted example, the relay 208*d* may be a normally-closed single-pole-single-throw and the relay condition 210*d* may be a simple binary condition of the relay 208*d*, e.g., the relay 208*d* may be a relay without a delay such that once a switching signal is received the relay 208*d* immediately switches states.

Turning next to indication 205, the indication 205 may be representative of a request for a cooling mode, e.g., to provide a defrost mode to the outdoor unit of the climate control system. As shown, the indication 205 passes from the electronic circuitry 204 to the compressor 108 in order to cause the climate control system to operate in a cooling mode as previously described above for FIG. 2A. Further, the indication 205 is received by relay 208*b* also previously described above for FIG. 2A. As shown in FIG. 2B, the indication 205 further passes to the relay of 208*d* and causes the relay condition 210*d* to switch the relay 208*d* from the normally-closed state to the open state. As a result, the indication 205 causes the climate control system to operate according to a cooling mode and further causes the high stage of the compressor 108 to be locked out while the climate control system is in a cooling mode.

Moreover, it should be appreciated that when a request for a heating mode is received then the relay 208*d* would return to the closed state allowing for the high stage of the compressor 108 to be enabled. It should be further appreciated that in the depicted examples of FIG. 2B the compressor 108 may operate in only a low stage during cooling mode operations of the climate control system. However, the compressor 108 may operate in any of a low stage, a high stage, and an elevated third-stage during heating mode operations of the climate control system when the required conditions of the electronic circuitry 204 are met. In such examples, the climate control system has one cooling capacity and three heating capacities, e.g., each conditioning capacity being defined at least partially by a respective stage of the compressor.

Furthermore, it should be understood that while the compressor 108 may only operate in a low stage when there is a demand for cooling, e.g., a first cooling mode, other components of the climate control system, e.g., the indoor fan 110, may still provide additional levels of cooling capacity as described by the present disclosure, e.g., a second cooling mode. In such examples, the climate control system may have two cooling capacities and three heating capacities, e.g., each cooling capacity being defined by the same low stage of the compressor and a different respective speed of the indoor fan. Moreover, in some examples, the compressor may only operate in a high stage when there is a demand for cooling, e.g., the low stage is locked out in cooling mode. In some examples, locking out either the high stage or the low stage in cooling mode may be accomplished with one or more additional relays configured to force a solenoid valve of the compressor to remain in either the high stage or the low stage condition as described in further detail below.

FIGS. 3A-3D show schematic diagrams of a two-stage compressor 300 including a low stage and a high stage. The two-stage compressor 300 generally includes a housing 302, a motor 318, a primary refrigerant inlet port 304, a discharge port 306, a compression chamber 316 including a fixed scroll 316*a* and an orbital scroll 316*b*, and bypass refrigerant inlet ports 308*a*-308*b*. Further, as shown in the depicted example, the two-stage compressor 300 may be fluidly coupled to a refrigerant circuit 310 at the inlet port 304 and the discharge port 306 in order to convey refrigerant fluid through a climate control system. The two-stage compressor 300 may be the same or similar to the compressor 108 and/or any other compressor as described by the present disclosure. Further, the two-stage compressor 300 may be a component of climate control system 100 and/or any other climate control system as described by the present disclosure. The two-stage compressor 300 may include other components for compressing and conveying a refrigerant fluid that are not shown such as wiring, solenoid valves, check valves, and/or similar components. In the depicted examples of FIGS. 3A-3D, the two-stage compressor 300 may be a scroll compressor, however, the two-stage compressor may be any two-stage type compressor, e.g., a reciprocating compressor or the like. In some examples, the motor 318 may be an AC induction motor. In some examples, the motor 318 may comprise and/or be coupled to a power module and/or other drive componentry, e.g., variable frequency drive, gearbox, or the like. In some examples, the motor 318 may comprise a number of poles that correlate to an increased frequency and/or desired speed of the compressor 300.

Figure 3A:
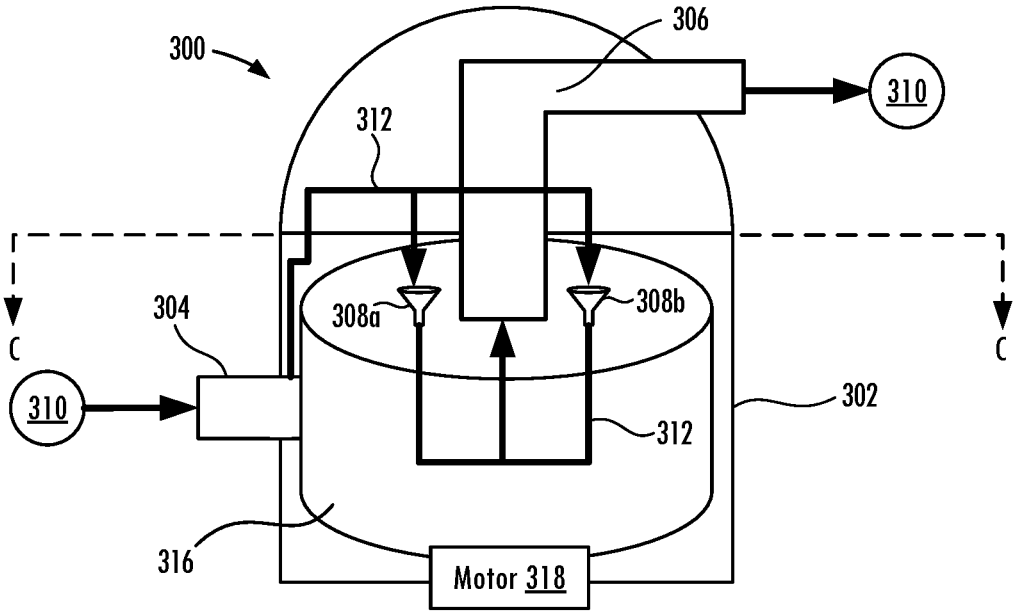

Turning to FIG. 3A, as shown, the two-stage compressor 300 is operating according to a low stage, e.g., in response to indication 201 or the like. During operation in the low stage, the primary refrigerant inlet port 304 is closed off, e.g., by a solenoid valve or the like, from the compression chamber 316 and instead directs the refrigerant fluid along the internal compressor refrigerant circuit 312. As the refrigerant fluid flows along the internal compressor refrigerant circuit 312, the refrigerant fluid enters the compression chamber 316 through the bypass refrigerant inlet ports 308*a*-308*b* which are open. In some examples, the bypass refrigerant inlet ports 308*a*-308*b* may be actuated by a solenoid valve or the like.

Figure 3B:
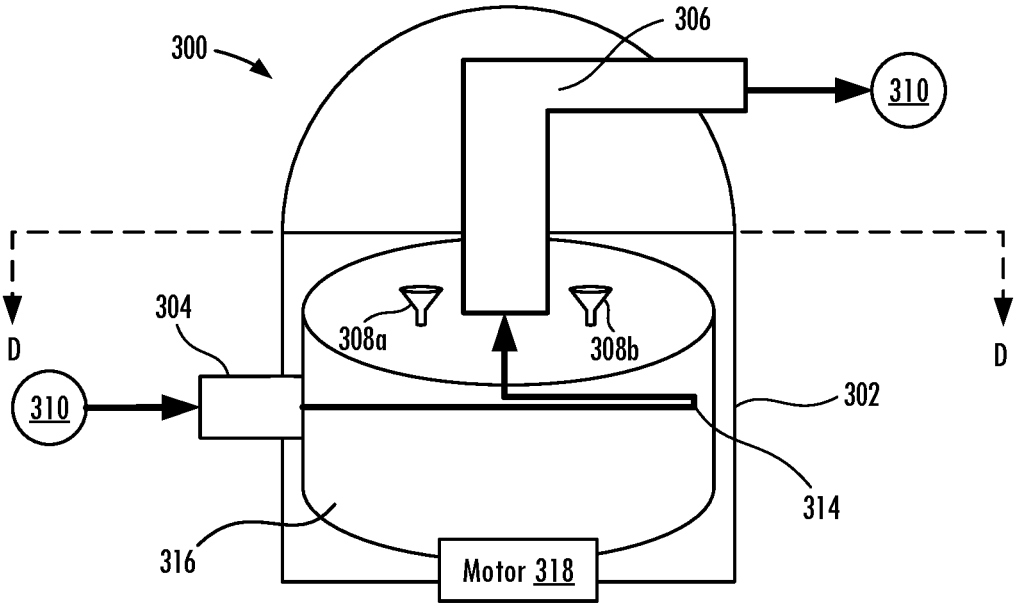
Figure 3C:
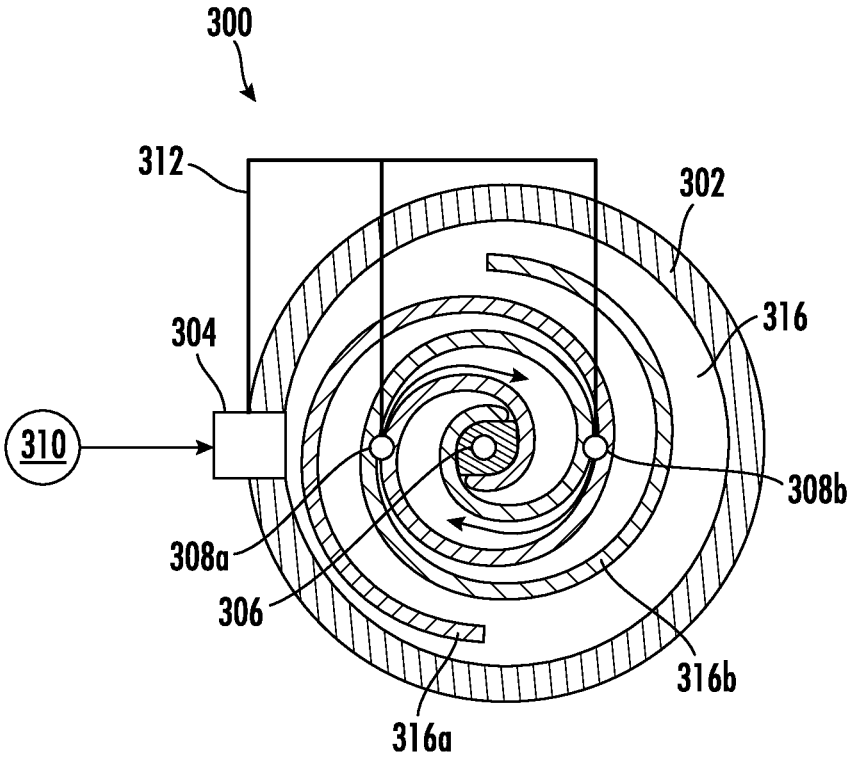

Turning to FIG. 3C which shows the view of section C-C relative to FIG. 3A, the refrigerant fluid entering through the bypass refrigerant inlet ports 308*a*-308*b* enters the compression chamber 316 at approximately the middle of the internal compression refrigerant circuit formed by the fixed scroll 316*a* and the orbital scroll 316*b*. The operation of the orbital scroll 316*b* compresses the refrigerant fluid and forces the refrigerant fluid toward the discharge port 306 where it exits the compression chamber and returns to the refrigerant circuit 310, as shown in FIG. 3A. It should be understood that because the internal compressor refrigerant circuit 312 only utilizes approximately half of the compression chamber 316, the internal compressor refrigerant circuit 312 may only provide less than the rated capacity of the compressor, e.g., approximately 65% of the rated capacity.

Turning to FIG. 3B, as shown, the two-stage compressor 300 is operating according to a high stage, e.g., in response to indication 203 or the like. During operation in the high stage, the primary refrigerant inlet port 304 is open allowing the refrigerant fluid to flow into the compression chamber 316. It should be understood that the refrigerant fluid may be blocked, e.g., by a solenoid valve or the like, from entering the internal compressor refrigerant circuit 312 from the primary refrigerant inlet port 304. Additionally, the bypass refrigerant inlet ports 308*a*-308*b* may be closed, e.g., by a solenoid valve to prevent the refrigerant fluid from flowing backwards into the internal compressor refrigerant circuit 312. It should be understood that similar bypass ports and bypass methods may be used with other types of two-stage compressors, e.g., reciprocating compressors, in order to bypass a portion of the compressors compression process and deliver a reduced capacity. In some examples, other compressors may be utilized with the climate control system described herein. In some examples, the climate control system may comprise other two-stage compressors such as two-stage rotary compressors and/or compressors that utilize different staging and compression mechanisms, e.g., a digital scroll compressor. In some examples, a two-stage rotary compressor may comprise a mechanically staged rotary including two cylinders. In such examples, the mechanically staged rotary may use one cylinder for a low stage, e.g., with the other cylinder restricted from receiving refrigerant while in the low stage. Further, in such examples, the mechanically staged rotary may use two cylinders for a high stage. In some examples, the climate control system may comprise a single speed compressor and/or a single stage compressor. In some examples, a digital scroll compressor may provide one or more stages by operating with varied pulse-width modulation (PWM), e.g., to modulate a delivered volume of refrigerant fluid. In such examples, the digital scroll compressor may provide one or more stages by periodically opening and closing a solenoid valve, e.g., to periodically displace the fixed scroll along the vertical axis.

Figure 3D:
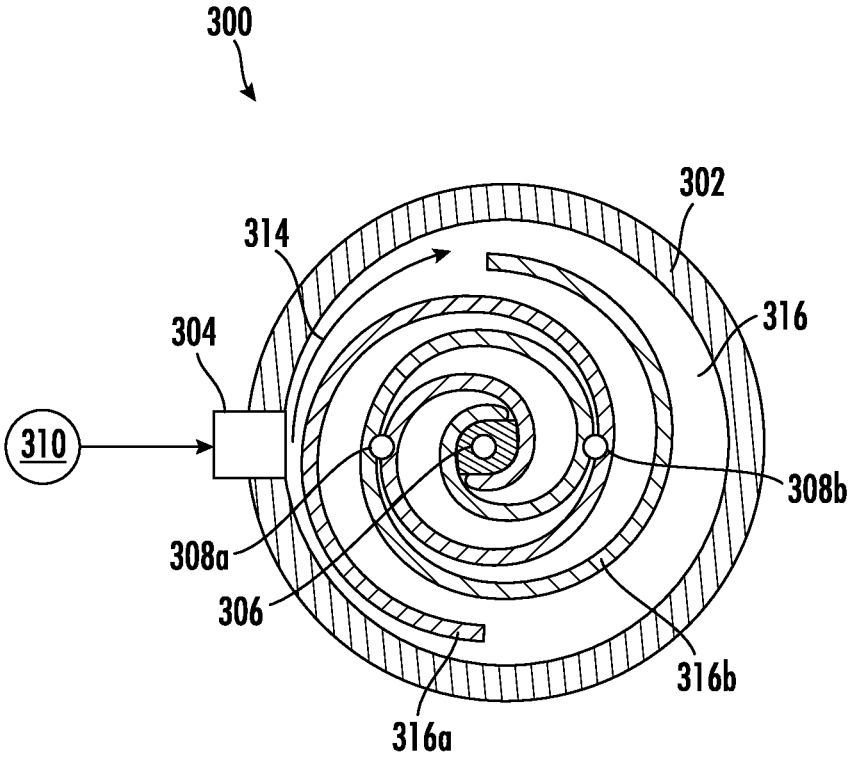

As shown, the refrigerant fluid flows along the internal compressor refrigerant circuit 314 entering the compression chamber 316 through the primary refrigerant inlet port 304. Turning to FIG. 3D, which shows the view of section D-D relative to FIG. 3B, the refrigerant fluid entering through the primary refrigerant inlet port 304 enters the compression chamber 316 generally at the beginning of the internal compression refrigerant circuit formed by the fixed scroll 316*a* and the orbital scroll 316*b*. The operation of the orbital scroll 316*b* compresses the refrigerant fluid and forces the refrigerant fluid toward the discharge port 306 where it exits the compression chamber and returns to the refrigerant circuit 310, as shown in FIG. 3B. It should be understood that because the internal compressor refrigerant circuit 314 utilizes substantially all of the compression chamber 316, the internal compressor refrigerant circuit 314 may provide the rated capacity of the compressor, e.g., 100% of the rated capacity.

Moreover, it should be appreciated that during operation at the low stage and the high stage as described above with reference to FIGS. 3A-3D the motor 318 utilizes the line power at the rated power input and the rated frequency. However, the high stage as described above with reference to FIGS. 3B and 3D may also be combined with the motor 318 when utilizing the modified power at the modified power input and the increased frequency to operate the two-stage compressor 300 at the elevated third-stage as described by the present disclosure.

Since the general climate control system, electronic circuitry, and compressor have been described in detail above. We will now walk through various different processes in further detail for operating a climate control system which utilizes the electronic circuitry, and the compressor as described below.

FIGS. 4A-4D show an example process 400 that may be utilized to operate a climate control system with electronic circuitry 204, as described above, in order to control the power supplied to a compressor, e.g., 108, 300. The process 400 may be carried out, at least partially, by one or more apparatuses, components, circuits, or the like according to some examples of the present disclosure. In some examples, the process 400 may be performed by at least control circuitry, e.g., 102, 200*a*, 200*b*. In some examples, the process 400 may utilize one or more other components coupled to the control circuitry, e.g., 102, 200*a*, 200*b*, and/or the compressor, e.g., 108, 300. It should be understood that the control circuitry, e.g., 102, 200*a*, 200*b* may include some or all of the control circuitry depicted in FIGS. 6-7 and described below.

Figure 4A:
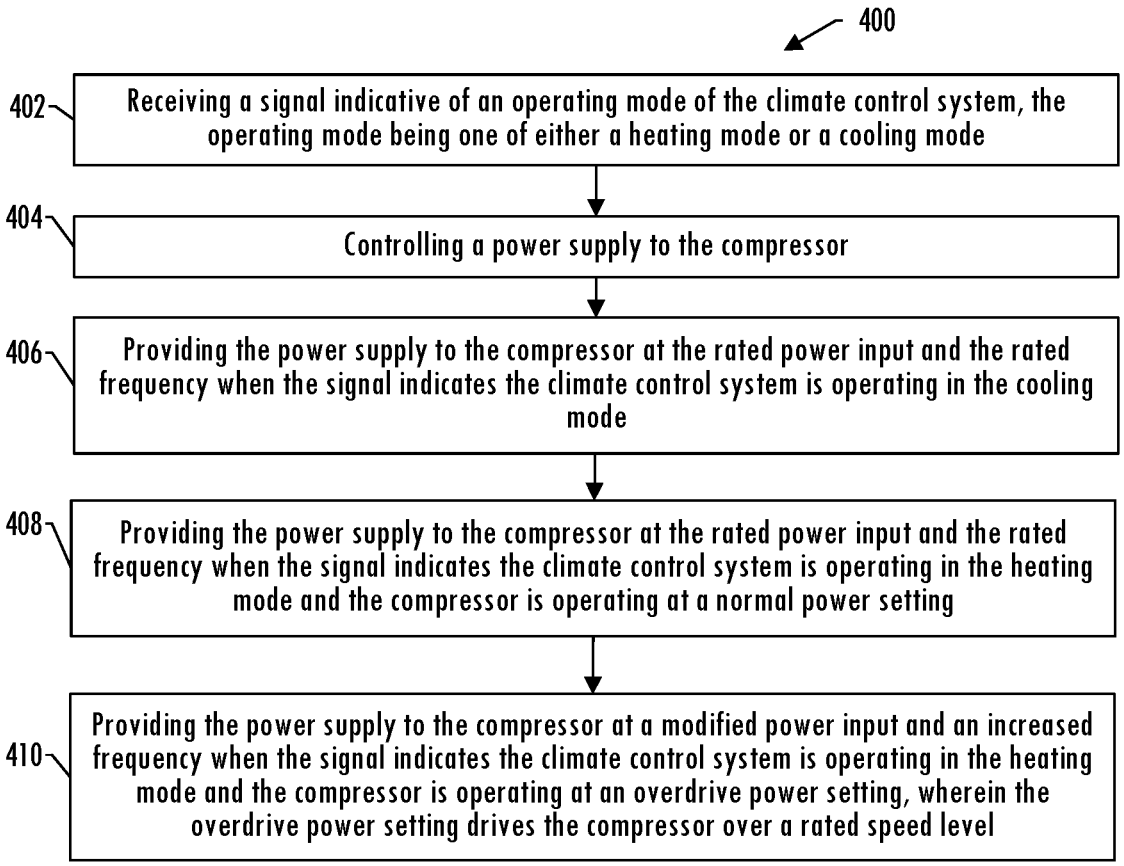

Referring first to the example provided in FIG. 4A, the process 400 may include receiving a signal indicative of an operating mode of the climate control system, the operating mode being one of either a heating mode or a cooling mode, as shown in step 402. As shown at step 404, the process 400 may also include controlling a power supply to the compressor. The process 400 may further include providing the power supply to the compressor at the rated power input and the rated frequency when the signal indicates the climate control system is operating in the cooling mode, as shown at step 406. The process 400 may further include providing the power supply to the compressor at the rated power input and the rated frequency when the signal indicates the climate control system is operating in the heating mode and the compressor is operating at a normal power setting, as shown at step 408. The process 400 may further include providing the power supply to the compressor at a modified power input and an increased frequency when the signal indicates the climate control system is operating in the heating mode and the compressor is operating at an overdrive power setting, wherein the overdrive power setting drives the compressor over a rated speed level, as shown at step 410.

To further walk through the process of controlling the power supplied to a compressor, each of steps 402-410 described above will now be discussed in more detail with further reference to FIGS. 4B-4D below.

As shown at step 402, the process 400 may include receiving a signal indicative of an operating mode of the climate control system, the operating mode being one of either a heating mode or a cooling mode. This may include operating the climate control system in one of either a heating mode or a cooling mode, and a signal may be provided associated with that operation. In some examples, step 402 may include a signal indicative of operating the system in either mode in response to a request for a respective conditioning mode, e.g., provided by a user via a 24V non-communicating thermostat or other interface. In some examples, the heating mode may further include a first heating mode operating the compressor at a partial heating capacity, a second heating mode operating the compressor at a rated heating capacity, and/or a third heating mode operating the compressor at an elevated heating capacity. In some examples, the cooling mode may further include a first cooling mode operating the compressor at a partial cooling capacity and a second cooling mode operating the compressor at a rated cooling capacity. In some examples, the cooling mode may include a first cooling mode operating the compressor at a partial cooling capacity and operating the indoor fan at a low speed. In such examples, the cooling mode may further include a second cooling mode operating the compressor at the same partial cooling capacity as the first cooling mode and operating the indoor fan at a high speed. In such examples, the indoor fan speed may not be operated proportionally to the compressor speed or stages. Still further combinations of heating and cooling modes may be included.

Turning next to step 404, the process 400 may include controlling a power supply to the compressor. In some examples, the step 404 may generally include each of steps 406, 408, and 410 and the switching therebetween, potentially in the manner described with respect to FIGS. 2A-2B. Further, step 404 may include gradually winding down the compressor to transition from a higher stage to a lower stage, e.g., from step 410 to step 406. The winding down process that may be included at step 404 may generally include gradually reducing the power input to the compressor. In some examples, the winding down process may include allowing inertia to slow down the speed of the compressor. Additionally, the step 404 may also include initiating a delay when the climate control system switches from the overdrive power setting to the normal power setting.

In some examples, a delay may be present for switching from a rated frequency to an increased frequency and/or vice versa. In some examples, the compressor may coast-to-stop without additional frequency winddown control when switching from a rated frequency to an increased frequency and/or vice versa. In some examples, the control circuitry, e.g., outdoor controller, overdrive circuitry, or the like, may compensate for back electromotive force (EMF) produced by the compressor and/or compressor motor during periods of winddown. In such examples, the control circuitry, e.g., outdoor controller, overdrive circuitry, or the like, may comprise one or more of a resistor, diode, or capacitor arranged in a circuit to prevent damage to the control circuitry from a back EMF produced during winddown operations. Still other methods may be used.

The process 400, as shown at step 406, may include providing the power supply to the compressor at the rated power input and the rated frequency when the signal indicates the climate control system is operating in the cooling mode. Turning now to FIG. 4D, the process step 406 may generally include step 426 and step 428 as shown. The process step 406 may further include operating the compressor at the low stage and provided the power supply at the normal power setting to the compressor when the signal indicates the climate control system is operating in the cooling mode operation, as shown at step 426. In some examples, step 406 may further include closing a primary refrigerant inlet port of the compressor and opening a bypass refrigerant inlet port to form an internal compressor refrigerant circuit configured to deliver a partial cooling capacity.

Figure 4B:
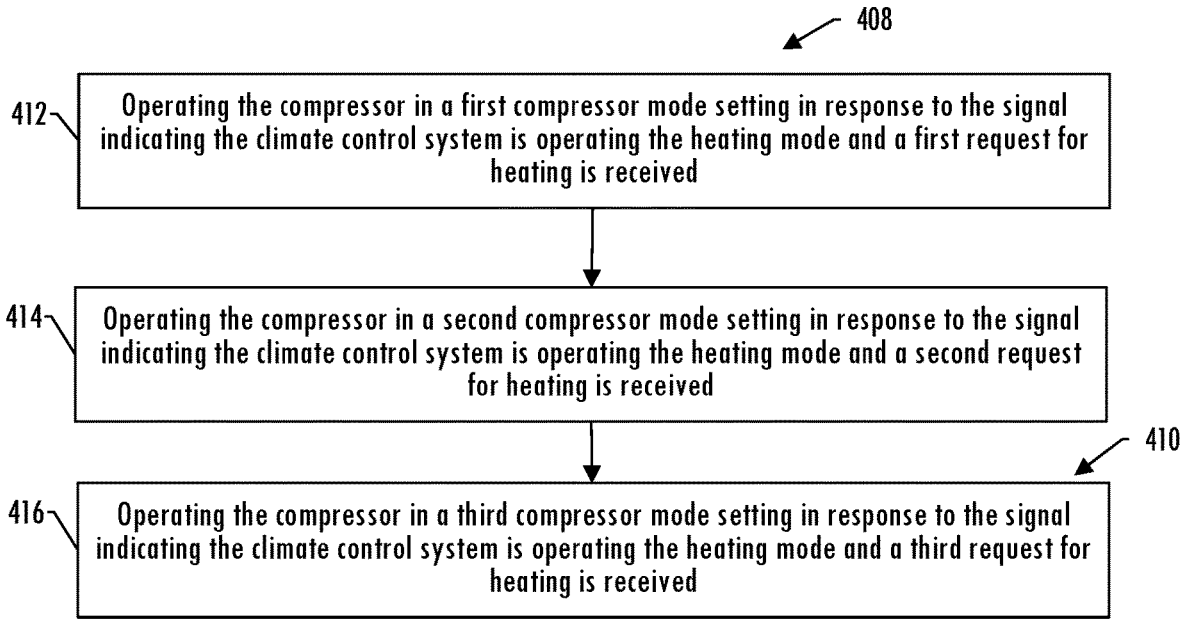
Figure 4C:
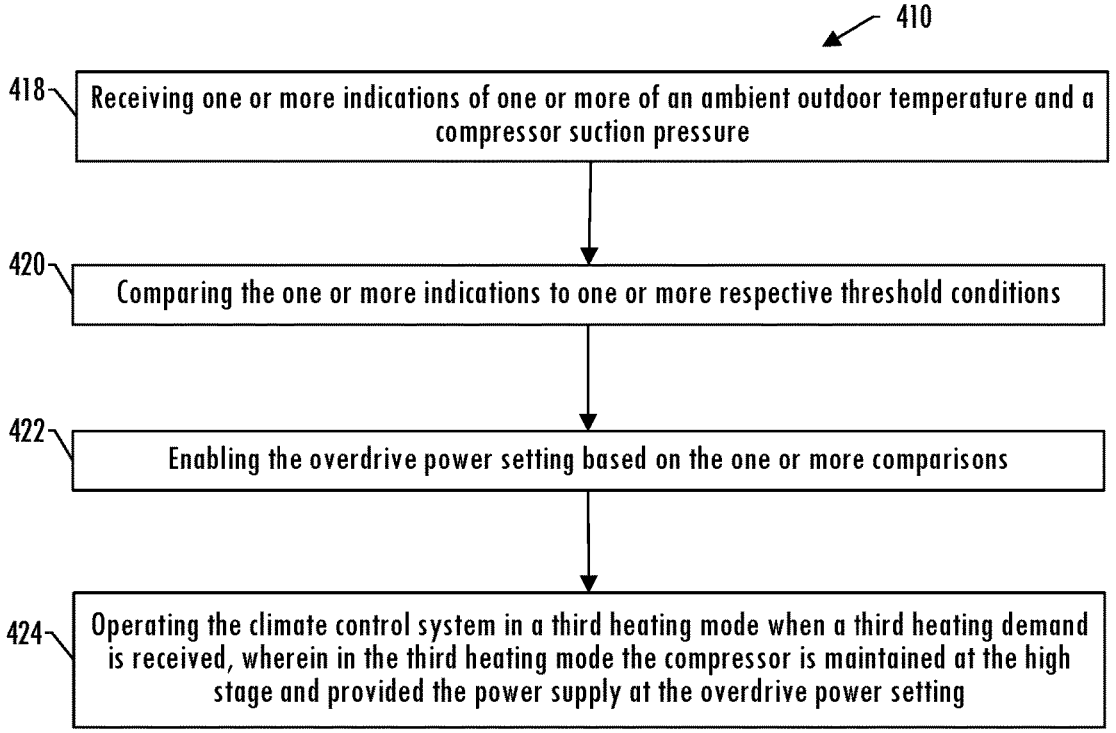
Figure 4D:
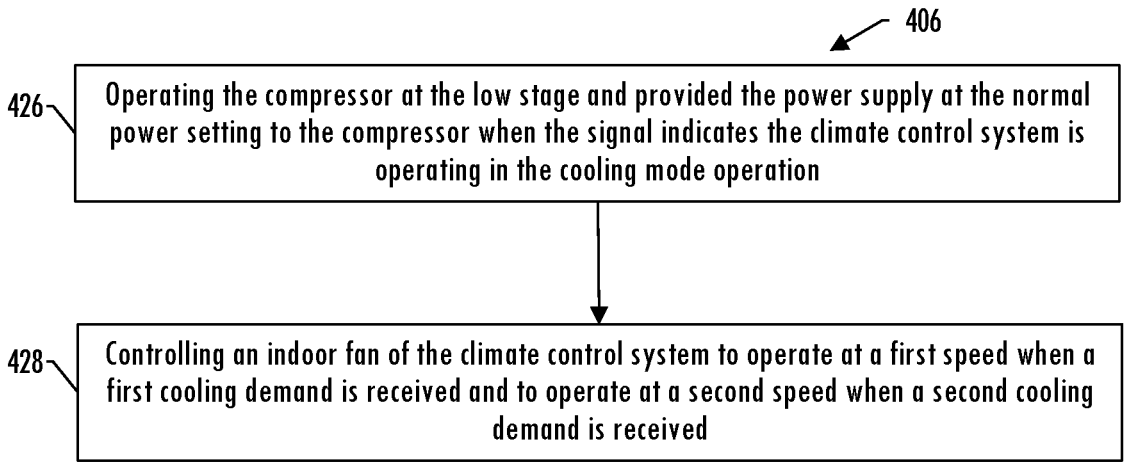

Still with reference to FIG. 4D, the process step 406 may further include controlling an indoor fan of the climate control system to operate at a first speed when a first cooling demand is received and to operate at a second speed when a second cooling demand is received, as shown at step 428. In some examples, switching between operating the indoor fan at the first speed and the second speed is uncoupled from switching between stages of the compressor. In some examples, the cooling demands or other requests/indications may be received from a 24V non-communicating thermostat and/or the like. Further, the process step 406 may include switching the indoor fan between the first speed and the second speed independently of switching, or maintaining, stages of the compressor.

Turning back to FIG. 4A and moving to step 408, the process 400 may include providing the power supply to the compressor at the rated power input and the rated frequency when the signal indicates the climate control system is operating in the heating mode and the compressor is operating at a normal power setting. Turning next to FIG. 4B the process step 408 may further generally include step 412, 414, and/or step 416.

Still with reference to FIG. 4B, the process step 408 may further include operating the compressor in a first compressor mode setting in response to the signal indicating the climate control system is operating the heating mode and a first request for heating is received, as shown at step 412. In these examples, the first compressor mode setting may operate the compressor at a partial compressor mode setting. For example, the first compressor mode setting may maintain the compressor at the low stage and the power supply provided may be controlled at the normal power setting to provide the compressor the rated power input and the rated frequency. In some examples, step 408 may further include closing a primary refrigerant inlet port of the compressor and opening a bypass refrigerant inlet port to form an internal compressor refrigerant circuit configured to deliver a partial heating capacity. In some examples, the internal compressor refrigerant circuit configured to deliver a partial heating capacity may be the same or similar internal compressor refrigerant circuit used to deliver a partial cooling capacity.

In some examples, the first request for heating is indicative of a first heating demand call. For example, the heating demand call may be indicative of the conditioning requirements for one or more spaces being conditioned by the climate control system. In some examples, the heating demand call may be indicative of parameters of the refrigerant system, e.g., suction pressure, saturation temperature, etc. These parameters may be used to provide an indication of the conditioning demand requested from the climate control system. In some examples, the request for heating may be indicative of the outdoor ambient temperature and/or other environmental conditions. In these examples, the heating demand request may correspond to the partial load compressor setting, e.g., the first compressor mode setting. In some examples, the first request for heating is provided through the various processes discussed above in connection with FIGS. 2A and 2B. Other heating requests may also be utilized. In some examples, the request for heating capacity corresponding to the partial compressor mode setting is considered a partial heating mode, potentially a first heating mode. Requests for cooling may be provided in a similar fashion as discussed herein with respect to requests for heating.

The process step 408 may further include operating the compressor in a second compressor mode setting in response to the signal indicating the climate control system is operating the heating mode and a second request for heating is received, as shown at step 414. In these examples, the second compressor mode setting may operate the compressor at a rated compressor mode setting. For example, the second compressor mode setting may maintain the compressor at the high stage and the power supply provided may be controlled at the normal power setting to provide the compressor the rated power input and the rated frequency. In some examples, step 408 may further include closing a bypass refrigerant inlet port of the compressor and opening a primary refrigerant inlet port to form an internal compressor refrigerant circuit configured to deliver at least a rated heating capacity. In some examples, the internal compressor refrigerant circuit configured to deliver a rated heating capacity may be the same or similar internal compressor refrigerant circuit used to deliver a rated cooling capacity. Further, it should be appreciated that the compressor may be maintained at the low stage or switched to the high stage while continuously providing the power supply at the normal power setting to the compressor. Furthermore, the switching command that causes the compressor to switch from the low stage to the high stage may be provided to the compressor along a communication bus, e.g., communication bus 628 as described below, that may be separate from any power bus that conveys a power input.

In some examples, the second request for heating is indicative of a second heating demand call. Again, the heating demand call may be indicative of the conditioning requirements for one or more spaces being conditioned by the climate control system, parameters of the refrigerant system, e.g., suction pressure, saturation temperature, etc., and/or environmental conditions, e.g., outdoor ambient temperature. In these examples, the heating demand request may correspond to the rated load compressor setting, e.g., the second compressor mode setting. In some examples, the second request for heating is provided through the various processes discussed above in connection with FIGS. 2A and 2B. Other heating requests may also be utilized. In some examples, the request for heating capacity corresponding to the rated compressor mode setting is considered a rated heating mode, potentially a second heating mode.

In some examples, the process step 410 may further include operating the compressor in a third compressor mode setting in response to the signal indicating the climate control system is operating the heating mode and a third request for heating is received, as shown at step 416. In these examples, the third compressor mode setting may operate the compressor at an overdrive compressor mode setting. For example, the third compressor mode setting may maintain the compressor at the high stage and the power supply provided is controlled at the overdrive power setting to provide the compressor the modified power input and the increased frequency. In these examples, the third compressor mode setting may operate the compressor at an elevated heating capacity. In some examples, the internal compressor refrigerant circuit configured to deliver an elevated heating capacity may be the same or similar internal compressor refrigerant circuit used to deliver an elevated cooling capacity.

In some examples, the third request for heating is indicative of a third heating demand call. Again, the heating demand call may be indicative of the conditioning requirements for one or more spaces being conditioned by the climate control system, parameters of the refrigerant system, e.g., suction pressure, saturation temperature, etc., and/or environmental conditions, e.g., outdoor ambient temperature. In these examples, the third heating demand request may correspond to the elevated compressor setting, e.g., the third compressor mode setting. In some examples, the third request for heating is provided through the various processes discussed above in connection with FIGS. 2A and 2B. Other heating requests may also be utilized. In some examples, the request for heating capacity corresponding to the rated compressor mode setting is considered an overdrive heating mode, potentially a third heating mode. In some examples, the third request for heating may comprise an internally generated indication that is automatically generated by, at least in part, a control circuit or a circuit thereof and the internally generated indication may be a combination, at least in part, of a Y1 indication, a Y2 indication, a sensor indication, or the like.

Turning back to FIG. 4A and moving to step 410, the process 400 may include providing the power supply to the compressor at a modified power input and an increased frequency when the signal indicates the climate control system is operating in the heating mode and the compressor is operating at an overdrive power setting, wherein the overdrive power setting drives the compressor over a rated speed level. Turning now to FIG. 4C, the process step 410 may generally include step 418, step 420, step 422, and step 424 as shown. Additionally, step 410 may generally include any methods for controlling the power supplied to the compressor based on sensor indications and threshold conditions as described by the present disclosure.

Still with reference to FIG. 4C, the process step 410 may include receiving one or more indications of one or more of an ambient outdoor temperature and a compressor suction pressure, as shown at step 418. In some examples, the ambient outdoor temperature may be received from a temperature sensor proximate the outdoor unit of the climate control system, e.g., a temperature sensor 212 or other similar sensors for monitoring the ambient outdoor temperature. In some examples, the compressor suction pressure may be received from a pressure sensor, e.g., a pressure sensor 214 or other similar sensors for monitoring refrigerant fluid temperature or pressure, proximate a refrigerant inlet port, e.g., primary refrigerant inlet port 304, of the compressor.

The process step 410 may further include comparing the one or more indications to one or more respective threshold conditions, as shown at step 420. In some examples, the threshold conditions may include an upper and lower limit related to a monitored condition, e.g., ambient outdoor temperature, suction pressure, etc., of the climate control system. For example, the threshold conditions may include a first threshold condition to close a relay and a second condition to open the same relay. The first threshold condition may be different from the second condition in order to prevent the relay from continuously switching when the monitored condition is hovering around the threshold condition. In some examples, the indications may be a request for a particular condition mode, e.g., a cooling demand, a first, a second or, a third heating demand, or the like. In such examples, the threshold conditions may include a binary condition to test if an indication is present or absent, e.g., an indication for a third heating demand was received.

Moreover, the process step 410 may further include comparing a first indication of the ambient outdoor temperature to a first threshold condition and comparing a second indication of the ambient outdoor temperature to a second threshold condition. Still the process step 410 may further include comparing the first indication of the compressor suction pressure to a first threshold condition and comparing the second indication of the compressor suction pressure to a second threshold condition. In some examples, other sensors and/or threshold conditions may be utilized, e.g., saturated suction pressure, compressor motor speed, etc. In some examples, the threshold condition may be a binary condition to test whether an indication was received or not received. Again, other methods may still be used. In some examples, the compressor may utilize hardware and/or software overcurrent protection, e.g., in the motor of the compressor and/or in a controller of the compressor. In such examples, the hardware and/or software overcurrent protection may include an overcurrent protection threshold that may be selected to allow for the overdrive power setting up to a predefined limit, e.g., 90 Hz, 120 Hz, or another frequency. In some examples, the hardware and/or software overcurrent protection may be configured to cease operation, at least in part, of the overdrive power setting and/or the compressor if the overcurrent protection threshold reaches and/or exceeds the predefined limit, e.g., 90 Hz, 120 Hz, or another frequency.

Still with reference to FIG. 4C, the process step 410 may include enabling the overdrive power setting based on the one or more comparisons, as shown at step 422. In some examples, the process step 410 may include locking out the overdrive power setting based on the one or more comparisons. For example, the overdrive power setting, which may be controlled by the overdrive circuitry 202 as described above, may be enabled based on a first comparison and may be locked out based on a second comparison. For example, a relay may close (thereby enabling a circuit) when the ambient outdoor temperature is determined to be below a threshold of 25° F., and then the relay may open (thereby breaking a circuit) when the temperature is determined to be above a second threshold 40° F. In some examples, the process step 410 may include locking out the overdrive power setting based on two comparisons. For example, both the ambient outdoor temperature and the suction pressure may be required to satisfy a respective condition to enable or lockout the overdrive setting.

In some examples, two comparisons may be required to enable the overdrive power setting while only one comparison may be required to lock out the overdrive power setting; or vice versa. The process step 410 may include enabling the overdrive power setting based on a comparison of a first time period to a second time period. Additionally, the process step 410 may include locking out the overdrive power setting based on a comparison of a first time period to a second time period. For example, a delay timer may be used to ensure that the climate control system does not switch between the overdrive power setting and the normal power setting too rapidly, which may cause damage to motor windings or refrigerant circuit components. In some examples, a comparison of conditioning modes may be required in addition to the above comparisons, e.g., the overdrive power setting may be enabled only for heating modes and/or locked out only in cooling modes. Still further comparisons may be utilized to enable or lock out the overdrive power setting.

Further, the process step 410 may include operating the climate control system in a third heating mode when a third heating demand is received, wherein in the third heating mode the compressor is maintained at the high stage and provided the power supply at the overdrive power setting, as shown at step 424. The process step 410 may further include operating the climate control system in the third heating mode only when the third heating demand is received and an outdoor ambient is below a threshold condition. In some examples, the process step 410 may further include initiating a delay, e.g., a delay timer, when the climate control system switches from the overdrive power setting to the normal power setting, e.g., from the third heating mode to a first/second heating mode, cooling/defrost mode, or the like. Moreover, the process step 410 may still include further steps for operating the climate control system in a third heating mode as described by the present disclosure.

FIGS. 5A-5C show an example process 500 that may be utilized to operate a climate control system with electronic circuitry 204 as described above to control the power supplied to a compressor, e.g., 108, 300. The process 500 may be carried out, at least partially, by one or more apparatuses, components, circuits, or the like according to some examples of the present disclosure. In some examples, the process 500 may be performed by at least control circuitry, e.g., 102, 200*a*, 200*b*. In some examples, the process 500 may utilize one or more other components coupled to the control circuitry, e.g., 102, 200*a*, 200*b*, and/or the compressor, e.g., 108, 300. It should be understood that the control circuitry, e.g., 102, 200*a*, 200*b* may include some or all of the control circuitry depicted in FIGS. 6-7 and described below.

Furthermore, the process 500 may generally relate to the indications and switching processes described above with respect to the control circuitry 200*a*-200*b* of FIGS. 2A-2B. However, the process 500 is further included here to provide additional example flowcharts in addition to the above descriptions of FIGS. 2A-2B.

Turning to FIG. 5A, the process 500 may include receiving a Y2 indication from the non-communicating thermostat at a first relay, the Y2 indication representative of a request for operation in a high stage of the compressor, the first relay being a normally-open single-pole-single-throw, as shown at step 502. The process 500 may include initiating a first timer upon receipt of the Y2 indication at the first relay, wherein the first timer is a delay-on-make timer of the first relay, as shown at step 504. The process 500 may include receiving a line power from a power supply at the first relay, the line power being at a rated power input and a rated frequency, as shown at step 506. The process 500 may include automatically closing the first relay upon termination of the first timer, wherein the closing of the first relay causes the line power to be provided from the first relay to a second relay through a third relay, the second relay being another normally-open single-pole-single-throw, the third relay being a normally-closed single-pole-single-throw, as shown at step 508. The process 500 may include receiving a threshold condition from a sensor at the second relay, the threshold condition representative of one of at least a suction pressure and an ambient outdoor temperature, as shown at step 510. The process 500 may include initiating a second timer upon receipt of the threshold condition at the second relay, wherein the second timer is a delay-on-make timer of the second relay, as shown at step 512. The process 500 may include automatically closing the second relay upon termination of the second timer, wherein the closing of the second relay causes the line power to be provided from the second relay to an overdrive circuitry, wherein the overdrive circuitry is configured to receive the line power at the rated power input and the rated frequency and modify the frequency of the line power to output a modified power input and an increased frequency to the compressor, as shown at step 514. The process 500 may include providing the modified power input and the increased frequency to the compressor, as shown at step 516.

Turning to FIG. 5B, the process 500 may further include receiving an O indication from the non-communicating thermostat at the third relay, the O indication being a request for a cooling mode, as shown at step 518. The process 500 may further include initiating a third timer upon receipt of the O indication at the third relay, wherein the third timer is a delay-on-make timer of the third relay, as shown at step 520. The process 500 may further include automatically opening the third relay upon termination of the third timer, wherein the opening of the third relay causes the line power to cease being provided from the first relay to the second relay, as shown at step 522.

Turning to FIG. 5C, the process 500 may further include receiving the Y2 indication from the non-communicating thermostat at a fourth relay, the fourth relay being another normally-closed single-pole-single-throw, wherein the Y2 indication is provided from the fourth relay to a control circuitry of an outdoor unit of the climate control system, as shown at step 524. The process 500 may further include Receiving the O indication from the non-communicating thermostat at the fourth relay, as shown at step 526. The process 500 may further include receiving the O indication from the non-communicating thermostat at the fourth relay, as shown at step 526. The process 500 may further include initiating a fourth timer upon receipt of the O indication at the fourth relay, wherein the fourth timer is a delay-on-make timer of the fourth relay, as shown at step 528. The process 500 may further include automatically opening the fourth relay upon termination of the fourth timer, wherein the opening of the fourth relay causes the line power to cease being provided from the fourth relay to the control circuitry of the outdoor unit of the climate control system, as shown at step 530.

FIG. 6 shows a schematic diagram for at least an example climate control system 600, which may be the same or similar to climate control system 100 discussed above. In some examples, the climate control system 600 comprises a heat pump system that may be selectively operated to implement one or more substantially closed thermodynamic refrigerant cycles to provide a cooling functionality (hereinafter a "cooling mode") and/or a heating functionality (hereinafter a "heating mode"). The examples depicted in FIG. 6 are configured in a cooling mode. The climate control system 600, in some examples is configured as a split system heat pump system, and generally comprises an indoor unit 602, an outdoor unit 604, and a system controller 606 that may generally control operation of the indoor unit 602 and/or the outdoor unit 604. The indoor unit 602 and the outdoor unit 604 may be fluidly coupled via the refrigerant fluid circuit 634, which may be the same or similar to refrigerant circuit 310 discussed above.

Indoor unit 602 generally comprises an indoor air handling unit comprising an indoor heat exchanger 608, an indoor fan 610, an indoor metering device 612, and an indoor controller 624. The indoor heat exchanger 608 may generally be configured to promote heat exchange between a refrigerant fluid carried within internal tubing of the indoor heat exchanger 608 and an airflow that may contact the indoor heat exchanger 608 but that is segregated from the refrigerant fluid. Indoor unit 602 may at least partially include, or be coupled to, a duct system 632 including one or more of an air return duct, a supply duct, a register, a vent, a damper, an air filter, or the like for providing airflow.

The indoor metering device 612 may generally comprise an electronically-controlled motor-driven electronic expansion valve (EEV). In some examples, however, the indoor metering device 612 may comprise a thermostatic expansion valve, a capillary tube assembly, and/or any other suitable metering device.

Outdoor unit 604 generally comprises an outdoor heat exchanger 614, a compressor 616, an outdoor fan 618, an outdoor metering device 620, a switch over valve 622, and an outdoor controller 626. The compressor 616 may be any type of compressor, including a compressor the same or similar to compressor 108, 300, as discussed above. The outdoor heat exchanger 614 may generally be configured to promote heat transfer between a refrigerant fluid carried within internal passages of the outdoor heat exchanger 614 and an airflow that contacts the outdoor heat exchanger 614 but is segregated from the refrigerant fluid.

The outdoor metering device 620 may generally comprise a thermostatic expansion valve. In some examples, however, the outdoor metering device 620 may comprise an electronically-controlled motor driven EEV similar to indoor metering device 612, a capillary tube assembly, and/or any other suitable metering device.

In some examples, the switch over valve 622 may generally comprise a four-way reversing valve. The switch over valve 622 may also comprise an electrical solenoid, relay, and/or other device configured to selectively move a component of the switch over valve 622 between operational positions to alter the flow path of refrigerant fluid through the switch over valve 622 and consequently the climate control system 600. Additionally, the switch over valve 622 may also be selectively controlled by the system controller 606, an outdoor controller 626, and/or the indoor controller 624.

The system controller 606 may generally be configured to selectively communicate with the indoor controller 624 of the indoor unit 602, the outdoor controller 626 of the outdoor unit 604, and/or other components of the climate control system 600. In some examples, the system controller 606 may be configured to control operation of the indoor unit 602, and/or the outdoor unit 604. In some examples, the system controller 606 may be configured to monitor and/or communicate with a plurality of temperature and pressure sensors associated with components of the indoor unit 602, the outdoor unit 604, and/or the outdoor ambient environment.

Additionally, in some examples, the system controller 606 may comprise a temperature sensor and/or may further be configured to control heating and/or cooling of conditioned spaces or zones associated with the climate control system 600. In some examples, the system controller 606 may be configured as a thermostat for controlling the supply of conditioned air to zones associated with the climate control system 600, and in some examples, the thermostat includes a temperature sensor.

The system controller 606 may also generally comprise an input/output (I/O) unit (e.g., a graphical user interface, a touchscreen interface, or the like) for displaying information and for receiving user inputs. The system controller 606 may display information related to the operation of the climate control system 600 and may receive user inputs related to operation of the climate control system 600. However, the system controller 606 may further be operable to display information and receive user inputs tangentially related and/or unrelated to operation of the climate control system 600. In some examples, the system controller 606 may not comprise a display and may derive all information from inputs that come from remote sensors and remote configuration tools.

In some examples, the system controller 606 may be configured for selective bidirectional communication over a communication bus 628, which may utilize any type of communication network. For example, the communication may be via wired or wireless data links directly or across one or more networks, such as a control network. Examples of suitable communication protocols for the control network include CAN, TCP/IP, BACnet, LonTalk, Modbus, ZigBee, Zwave, Wi-Fi, SIMPLE, Bluetooth, and the like. In some examples, the communication bus 628 may in whole, or in part, comprise a 24 volt (24V) connection that uses a 24V communication protocol. In some such examples, the 24V connection may be configured for unidirectional communication. For example, the system controller 606, and/or the thermostat 631, may be connected to the outdoor controller 626 via a 24V connection, and the communication protocol over the 24V connection to the outdoor controller 626 may comprise only binary signals transmitted from the system controller 606, and/or the thermostat 631, to the outdoor controller 626. In some examples, the communication from the system controller 606, and/or the thermostat 631, to the outdoor controller 626 may be only a call for heating and/or a call for cooling without any additional information. In some examples, the call for heating and/or the call for cooling may further include a call for a high stage or a low stage as described above.

The indoor controller 624 may be carried by the indoor unit 602 and may generally be configured to receive information inputs, transmit information outputs, and/or otherwise communicate with the system controller 606, the outdoor controller 626, and/or any other device 630 via the communication bus 628 and/or any other suitable medium of communication. In some examples, the device 630 may include some or all of the systems described by the present disclosure. For example, the device 630 may be a sensor, or the like, as described by the present disclosure. In some examples, the device 630 may be housed within at least a unit (e.g., 602, 604, etc.) of the climate control system 600 and/or coupled thereto. In some examples, the device 630 may be a plurality of devices, each device 630 being associated with one or more units of the climate control system 600.

An indoor electronic expansion valve (EEV) controller 638 may be configured to receive information regarding temperatures and/or pressures of the refrigerant in the indoor unit 602. More specifically, the indoor EEV controller 638 may be configured to receive information regarding temperatures and pressures of refrigerant entering, exiting, and/or within the indoor heat exchanger 608.

The outdoor controller 626 may be carried by the outdoor unit 604 and may be configured to receive information inputs from the system controller 606, which may be a thermostat. In some examples, the outdoor controller 626 may be configured to receive information related to an ambient temperature associated with the outdoor unit 604, information related to a temperature of the outdoor heat exchanger 614, and/or information related to refrigerant temperatures and/or pressures of refrigerant entering, exiting, and/or within the outdoor heat exchanger 614 and/or the compressor 616.

In some examples, the outdoor controller 626 and/or any other control circuitry configured to control the outdoor unit 604 is further coupled to a thermostat 631. In some of these examples, the thermostat 631 is a non-communicating thermostat that provides limited control information. For example, the thermostat 631 may communicate via a 24V communication protocol, which in some examples, only provides the outdoor controller 626 and/or any other control circuitry with information regarding whether to operate or not and/or which conditioning mode is requested, e.g., a cooling mode or a heating mode. In these examples, the non-communicating thermostat may not provide any other information regarding the climate control system 600 and/or the desired operation. For example, the non-communicating thermostat may not provide any information regarding the temperature setpoint of a given space to be conditioned, the operating conditions of the indoor unit 602, e.g., temperature or pressure of the refrigerant fluid in the indoor unit 602, conditioning air entering or exiting temperature, or any information regarding the outdoor ambient environment.

In some examples, the outdoor unit 604 may be coupled to a communicating thermostat that utilizes more advanced communication protocols, e.g., a communicating thermostat, but these communication protocols may be incompatible with the outdoor controller 626 and/or any other control circuitry controlling the outdoor unit 604. In these examples, the communicating thermostat may control the outdoor unit 604 in a similar manner to the non-communicating thermostat, e.g., sending control information via a 24V communication protocol or other limited communication protocols. In some examples, the outdoor controller 626 and/or any other control circuitry configured to control the outdoor unit 604 may include in whole, or in part, control circuitry, e.g., control circuitry 102, 200*a*, 200*b* or the like, that improves the operation of the components of the outdoor unit 604 regardless of the information (or lack thereof) provided by a thermostat.

FIG. 7 illustrates the control circuitry 700, which may be an apparatus, according to some examples of the present disclosure. In some examples the control circuitry 700 includes some or all of the system controller 606, the indoor controller 624, the outdoor controller 626, or any other similar apparatus as described by the present disclosure. In some examples, the control circuitry 700 may include one or more of each of a number of components such as, for example, a processor 702 connected to a memory 704. The processor is generally any piece of computer hardware capable of processing information such as, for example, data, computer programs and/or other suitable electronic information. The processor includes one or more electronic circuits some of which may be packaged as an integrated circuit or multiple interconnected integrated circuits (an integrated circuit at times more commonly referred to as a "chip"). The processor 702 may be a number of processors, a multi-core processor or some other type of processor, depending on the particular example.

The processor 702 may be configured to execute computer programs such as computer-readable program code 706, which may be stored onboard the processor or otherwise stored in the memory 704. In some examples, the processor may be embodied as, or otherwise include, one or more ASICs, FPGAs or the like. Thus, although the processor may be capable of executing a computer program to perform one or more functions, the processor of various examples may be capable of performing one or more functions without the aid of a computer program.

The memory 704 is generally any piece of computer hardware capable of storing information such as, for example, data, computer-readable program code 706 or other computer programs, and/or other suitable information either on a temporary basis and/or a permanent basis. The memory may include volatile memory such as random access memory (RAM), and/or non-volatile memory such as a hard drive, flash memory or the like. In various instances, the memory may be referred to as a computer-readable storage medium, which is a non-transitory device capable of storing information. In some examples, then, the computer-readable storage medium is non-transitory and has computer-readable program code stored therein that, in response to execution by the processor 702, causes the control circuitry 700 to perform various operations as described herein, some of which may in turn cause the climate control system to perform various operations.

In addition to the memory 704, the processor 702 may also be connected to one or more peripherals such as a network adapter 708, one or more input/output (I/O) devices (e.g., input device(s) 710, output device(s) 712) or the like. The network adapter is a hardware component configured to connect the control circuitry 700 to a computer network to enable the control circuitry to transmit and/or receive information via the computer network. The I/O devices may include one or more input devices capable of receiving data or instructions for the control circuitry, and/or one or more output devices capable of providing an output from the control circuitry. Examples of suitable input devices include a keyboard, keypad or the like, and examples of suitable output devices include a display device such as a one or more light-emitting diodes (LEDs), a LED display, a liquid crystal display (LCD), or the like.

As explained above and reiterated below, the present disclosure includes, without limitation, the following example implementations.

Clause 1. A climate control system comprising: a compressor including one or more stages, the compressor configured to receive a rated power input at a rated frequency; and control circuitry including electronic circuitry coupled to the compressor and providing a power supply to the compressor, the control circuitry configured to: receive a signal indicative of an operating mode of the climate control systems, the operating mode being one of either a heating mode or a cooling mode, and control the power supply to the compressor, wherein in the cooling mode the power supply provided to the compressor is at the rated power input and the rated frequency, wherein in heating mode during a normal power setting the power supply provided to the compressor is at the rated power input and the rated frequency, and wherein in the heating mode during an overdrive power setting the power supply provided to the compressor is at a modified power input and an increased frequency, wherein the overdrive power setting drives the compressor over a rated speed level.

Clause 2. The climate control system in any of the clauses, wherein the electronic circuitry is configured to receive a line power at the rated power input and the rated frequency and modify the rated frequency of the line power to output the modified power input and the increased frequency.

Clause 3. The climate control system in any of the clauses, wherein the control circuitry further comprises a switching circuitry configured to switch the electronic circuitry between a first power circuit that conveys a line power at the rated power input and the rated frequency and a second power circuit that receives the line power and provides the modified power input and the increased frequency.

Clause 4. The climate control system in any of the clauses, wherein the control circuitry is further configured to maintain the compressor at a low stage of the one or more stages when the signal indicates the climate control system is operating in the cooling mode, and wherein the switching circuitry is configured to lock out the second power circuit in the cooling mode.

Clause 5. The climate control system in any of the clauses, further comprising: a temperature sensor coupled to the switching circuitry, the temperature sensor configured to provide an indication of an ambient outdoor temperature, and wherein the switching circuitry is configured to lock out the second power circuit based on the indication from the temperature sensor.

Clause 6. The climate control system in any of the clauses, further comprising: a pressure sensor coupled to the switching circuitry, the pressure sensor configured to provide an indication of a compressor suction pressure, and wherein the switching circuitry is configured to lock out the second power circuit based on the indication from the pressure sensor.

Clause 7. The climate control system in any of the clauses, wherein the switching circuitry includes a delay timer, the delay timer configured to initiate a delay when the climate control system switches from the overdrive power setting to the normal power setting.

Clause 8. The climate control system in any of the clauses, wherein the switching circuit includes a mechanical relay, wherein the mechanical relay is one of at least the following a normally open relay, normally closed relay, single-pole-single-throw relay, and single-pole-double-throw relay.

Clause 9. The climate control system in any of the clauses, wherein the control circuitry is further configured to: operate the compressor in a first compressor mode setting in response to the signal indicating the climate control system is operating the heating mode and receiving a first request for heating, wherein in the first compressor mode setting the compressor is maintained at a first stage of the one or more stages and the power supply provided is controlled at the normal power setting to provide the compressor the rated power input and the rated frequency, the first compressor mode setting operating the compressor at a partial heating capacity, operate the compressor in a second compressor mode setting in response to the signal indicating the climate control system is operating the heating mode and receiving a second request for heating, wherein in the second compressor mode setting the compressor is maintained at a second stage of the one or more stages and the power supply provided is controlled at the normal power setting to provide the compressor the rated power input and the rated frequency, the second compressor mode setting operating the compressor at a rated heating capacity, operate the compressor in a third compressor mode setting operating in response to the signal indicating the climate control system is operating the heating mode and receiving a third request for heating, wherein the third compressor mode setting the compressor is maintained at the second stage of the one or more stages and the power supply provided is controlled at the overdrive power setting to provide the compressor the modified power input and the increased frequency, the third compressor mode setting operating the compressor at an elevated heating capacity.

Clause 10. The climate control system in any of the clauses, wherein the first stage of the one or more stages is a low stage, and wherein the second stage of the one or more stages is a high stage.

Clause 11. The climate control system in any of the clauses, further comprising: an air handler unit including an indoor fan, the indoor fan configured to operate at a plurality of speeds, wherein the control circuitry is further configured to control the indoor fan to operate at a first of the plurality of speeds when a first cooling demand is received and at a second of the plurality of speeds when a second cooling demand is received.

Clause 12. The climate control system in any of the clauses, wherein the compressor is a two-stage scroll compressor including a primary refrigerant inlet port and a bypass refrigerant inlet port defining internal compressor refrigerant circuits, wherein the one or more stages includes a low stage and a high stage, wherein during operation in the low stage, the primary refrigerant inlet port is closed and the bypass refrigerant inlet port is open, and wherein during operation in the high stage, the primary refrigerant inlet port is open and the bypass refrigerant inlet port is closed.

Clause 13. The climate control system in any of the clauses, wherein the rated frequency is 50 Hertz to 60 Hertz, and the increased frequency is equal to or less than 90 Hertz.

Clause 14. The climate control system in any of the clauses, wherein the rated frequency is 50 Hertz to 60 Hertz, and the increased frequency is equal to or less than 120 Hertz.

Clause 15. The climate control system in any of the clauses, wherein the overdrive power setting drives the compressor at equal to or less than 150% of the rated speed level.

Clause 16. The climate control system in any of the clauses, wherein the compressor is one or more of a reciprocating compressor, a scroll compressor, a digital scroll compressor, a screw compressor, a rotary compressor, a centrifugal compressor, a single-stage compressor, a two-stage compressor, or a single speed compressor.

Clause 17. The climate control system in any of the clauses, wherein the compressor is a two-stage compressor, and wherein the one or more stages includes a low stage and a high stage.

Clause 18. A method of controlling communication between a non-communicating thermostat and a compressor of a climate control system with a switching circuitry to provide a third heating mode: receiving a Y2 indication from the non-communicating thermostat at a first relay, the Y2 indication representative of a request for operation in a high stage of the compressor, the first relay being a normally-open single-pole-single-throw; initiating a first timer upon receipt of the Y2 indication at the first relay, wherein the first timer is a delay-on-make timer of the first relay; receiving a line power from a power supply at the first relay, the line power being at a rated power input and a rated frequency; automatically closing the first relay upon termination of the first timer, wherein the closing of the first relay causes the line power to be provided from the first relay to a second relay through a third relay, the second relay being another normally-open single-pole-single-throw, the third relay being a normally-closed single-pole-single-throw; receiving a threshold condition from a sensor at the second relay, the threshold condition representative of one of at least a suction pressure and an ambient outdoor temperature; initiating a second timer upon receipt of the threshold condition at the second relay, wherein the second timer is a delay-on-make timer of the second relay; automatically closing the second relay upon termination of the second timer, wherein the closing of the second relay causes the line power to be provided from the second relay to an overdrive circuitry, wherein the overdrive circuitry is configured to receive the line power at the rated power input and the rated frequency and modify the frequency of the line power to output a modified power input and an increased frequency to the compressor; and providing the modified power input and the increased frequency to the compressor Clause 19. The method in any of the clauses, further comprising: receiving an O indication from the non-communicating thermostat at the third relay, the O indication being a request for a cooling mode; initiating a third timer upon receipt of the O indication at the third relay, wherein the third timer is a delay-on-make timer of the third relay; and automatically opening the third relay upon termination of the third timer, wherein the opening of the third relay causes the line power to cease being provided from the first relay to the second relay.

Clause 20. The method in any of the clauses, receiving the Y2 indication from the non-communicating thermostat at a fourth relay, the fourth relay being another normally-closed single-pole-single-throw, wherein the Y2 indication is provided from the fourth relay to a control circuitry of an outdoor unit of the climate control system; receiving the O indication from the non-communicating thermostat at the fourth relay; initiating a fourth timer upon receipt of the O indication at the fourth relay, wherein the fourth timer is a delay-on-make timer of the fourth relay; and automatically opening the fourth relay upon termination of the fourth timer, wherein the opening of the fourth relay causes the line power to cease being provided from the fourth relay to the control circuitry of the outdoor unit of the climate control system.

Clause 21. A method of controlling a compressor of a climate control system, the compressor including one or more stages and configured to receive a rated power input at a rated frequency, the method comprising: receiving a signal indicative of an operating mode of the climate control system, the operating mode being one of either a heating mode or a cooling mode; controlling a power supply to the compressor; providing the power supply to the compressor at the rated power input and the rated frequency when the signal indicates the climate control system is operating in the cooling mode; providing the power supply to the compressor at the rated power input and the rated frequency when the signal indicates the climate control system is operating in the heating mode and the compressor is operating at a normal power setting; and providing the power supply to the compressor at a modified power input and an increased frequency when the signal indicates the climate control system is operating in the heating mode and the compressor is operating at an overdrive power setting, wherein the overdrive power setting drives the compressor over a rated speed level.

Clause 22. The method in any of the clauses, the method further comprises: operating the compressor in a first compressor mode setting in response to the signal indicating the climate control system is operating the heating mode and a first request for heating is received, wherein in the first compressor mode setting the compressor is maintained at a first stage of the one or more stages and the power supply provided is controlled at the normal power setting to provide the compressor the rated power input and the rated frequency, the first compressor mode setting operating the d compressor at a partial heating capacity, operating the compressor in a second compressor mode setting in response to the signal indicating the climate control system is operating the heating mode and a second request for heating is received, wherein in the second compressor mode setting the compressor is maintained at a second stage of the one or more stages and the power supply provided is controlled at the normal power setting to provide the compressor the rated power input and the rated frequency, the second compressor mode setting operating the compressor at a rated heating capacity, operating the compressor in a third compressor mode setting in response to the signal indicating the climate control system is operating the heating mode and a third request for heating is received, wherein in the third compressor mode setting the compressor is maintained at the second stage of the one or more stages and the power supply provided is controlled at the overdrive power setting to provide the compressor the modified power input and the increased frequency, the third compressor mode setting operating the compressor at an elevated heating capacity.

Clause 23. The method in any of the clauses, wherein the first stage of the one or more stages is a low stage, and wherein the second stage of the one or more stages is a high stage.

Clause 24. The method in any of the clauses, further comprising: monitoring an ambient outdoor temperature; and locking out the overdrive power setting based on the ambient outdoor temperature.

Clause 25. The method in any of the clauses, wherein locking out the overdrive power setting further includes: receiving a first indication of the ambient outdoor temperature, comparing the first indication of the ambient outdoor temperature to a first threshold condition, and locking out the overdrive power setting based on the first comparison; and the method further comprises enabling the overdrive power setting after the overdrive power setting is locked out, wherein enabling the overdrive power setting includes: receiving a second indication of the ambient outdoor temperature; comparing the second indication of the ambient outdoor temperature to a second threshold condition, and enabling the overdrive power setting based on the second comparison.

Clause 26. The method in any of the clauses, further comprising: monitoring a compressor suction pressure; and locking out the overdrive power setting based on the compressor suction pressure.

Clause 27. The method in any of the clauses, wherein locking out the overdrive power setting further includes:

receiving a first indication from the compressor suction pressure, comparing the first indication of the compressor suction pressure to a first threshold condition, and locking out the overdrive power setting based on the first comparison; and the method further comprises enabling the overdrive power setting after the overdrive power setting is locked out, wherein enabling the overdrive power setting includes: receiving a second indication of the compressor suction pressure; comparing the second indication of the compressor suction pressure to a second threshold condition, and enabling the overdrive power setting based on the second comparison.

Clause 28. The method in any of the clauses, further comprising: initiating a delay when the climate control system switches from the overdrive power setting to the normal power setting.

Clause 29. The method in any of the clauses, further comprising: operating the compressor at the low stage and provided the power supply at the normal power setting to the compressor when the signal indicates the climate control system is operating in the cooling mode operation; and controlling an indoor fan of the climate control system to operate at a first speed when a first cooling demand is received and to operate at a second speed when a second cooling demand is received.

Many modifications, other embodiments, examples, or implementations of the disclosure set forth herein will come to mind to one skilled in the art to which the disclosure pertains having the benefit of the teachings presented in the foregoing description and the associated figures. Therefore, it is to be understood that the disclosure is not to be limited to the specific embodiments, examples, or implementations disclosed and that modifications and other embodiments, examples, or implementations are intended to be included within the scope of the appended claims. Moreover, although the foregoing description and the associated figures describe embodiments, examples, or implementations in the context of certain example combinations of elements and/or functions, it should be appreciated that different combinations of elements and/or functions may be provided by alternative embodiments, examples, or implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A climate control system comprising:

a compressor including one or more stages, the compressor configured to receive a rated power input at a rated frequency; and control circuitry including electronic circuitry coupled to the compressor and providing a power supply to the compressor, the control circuitry configured to:

receive a signal indicative of an operating mode of the climate control system, the operating mode being one of either a heating mode or a cooling mode, and control the power supply to the compressor, wherein in the cooling mode the power supply provided to the compressor is at the rated power input and the rated frequency, wherein in the heating mode during a normal power setting the power supply provided to the compressor is at the rated power input and the rated frequency, wherein in the heating mode during an overdrive power setting the power supply provided to the compressor is at a modified power input and an increased frequency, and wherein the overdrive power setting drives the compressor over a rated speed level.

2. The climate control system of claim 1, wherein the electronic circuitry is configured to receive a line power at the rated power input and the rated frequency and modify the rated frequency of the line power to output the modified power input and the increased frequency.

3. The climate control system of claim 1, wherein the control circuitry further comprises a switching circuitry configured to switch the electronic circuitry between a first power circuit that conveys a line power at the rated power input and the rated frequency and a second power circuit that receives the line power and provides the modified power input and the increased frequency.

4. The climate control system of claim 3, wherein the control circuitry is further configured to maintain the compressor at a low stage of the one or more stages when the signal indicates the climate control system is operating in the cooling mode, and wherein the switching circuitry is configured to lock out the second power circuit in the cooling mode.

5. The climate control system of claim 3, further comprising:

a temperature sensor coupled to the switching circuitry, the temperature sensor configured to provide an indication of an ambient outdoor temperature, and wherein the switching circuitry is configured to lock out the second power circuit based on the indication from the temperature sensor.

6. The climate control system of claim 3, further comprising:

a pressure sensor coupled to the switching circuitry, the pressure sensor configured to provide an indication of a compressor suction pressure, and wherein the switching circuitry is configured to lock out the second power circuit based on the indication from the pressure sensor.

7. The climate control system of claim 3, wherein the switching circuitry includes a delay timer, the delay timer configured to initiate a delay when the climate control system switches from the overdrive power setting to the normal power setting.

8. The climate control system of claim 1, wherein the control circuitry is further configured to:

operate the compressor in a first compressor mode setting in response to the signal indicating the climate control system is operating in the heating mode and receiving a first request for heating, wherein in the first compressor mode setting the compressor is maintained at a first stage of the one or more stages and the power supply provided is controlled at the normal power setting to provide the compressor the rated power input and the rated frequency, the first compressor mode setting operating the compressor at a partial heating capacity;

operate the compressor in a second compressor mode setting in response to the signal indicating the climate control system is operating in the heating mode and receiving a second request for heating, wherein in the second compressor mode setting the compressor is maintained at a second stage of the one or more stages and the power supply provided is controlled at the normal power setting to provide the compressor the rated power input and the rated frequency, the second compressor mode setting operating the compressor at a rated heating capacity; and operate the compressor in a third compressor mode setting in response to the signal indicating the climate control system is operating in the heating mode and receiving a third request for heating, wherein in the third compressor mode setting the compressor is maintained at the second stage of the one or more stages and the power supply provided is controlled at the overdrive power setting to provide the compressor the modified power input and the increased frequency, the third compressor mode setting operating the compressor at an elevated heating capacity.

9. The climate control system of claim 8, wherein the first stage of the one or more stages is a low stage, and wherein the second stage of the one or more stages is a high stage.

10. The climate control system of claim 1, further comprising:

an air handler unit including an indoor fan, the indoor fan configured to operate at a plurality of speeds, wherein the control circuitry is further configured to control the indoor fan to operate at a first of the plurality of speeds when a first cooling demand is received and at a second of the plurality of speeds when a second cooling demand is received.

11. The climate control system of claim 1, wherein the compressor is one or more of a reciprocating compressor, a scroll compressor, a digital scroll compressor, a screw compressor, a rotary compressor, a centrifugal compressor, a single-stage compressor, a two-stage compressor, or a single speed compressor.

12. The climate control system of claim 1, wherein the compressor is a two-stage compressor, and wherein the one or more stages includes a low stage and a high stage.

13. A method of controlling a compressor of a climate control system, the compressor including one or more stages and configured to receive a rated power input at a rated frequency, the method comprising:

receiving a signal indicative of an operating mode of the climate control system, the operating mode being one of either a heating mode or a cooling mode;

controlling a power supply to the compressor;

providing the power supply to the compressor at the rated power input and the rated frequency when the signal indicates the climate control system is operating in the cooling mode;

providing the power supply to the compressor at the rated power input and the rated frequency when the signal indicates the climate control system is operating in the heating mode and the compressor is operating at a normal power setting; and providing the power supply to the compressor at a modified power input and an increased frequency when the signal indicates the climate control system is operating in the heating mode and the compressor is operating at an overdrive power setting, wherein the overdrive power setting drives the compressor over a rated speed level.

14. The method of claim 13, the method further comprises:

operating the compressor in a first compressor mode setting in response to the signal indicating the climate control system is operating in the heating mode and a first request for heating is received, wherein in the first compressor mode setting the compressor is maintained at a first stage of the one or more stages and the power supply provided is controlled at the normal power setting to provide the compressor the rated power input and the rated frequency, the first compressor mode setting operating the compressor at a partial heating capacity;

operating the compressor in a second compressor mode setting in response to the signal indicating the climate control system is operating in the heating mode and a second request for heating is received, wherein in the second compressor mode setting the compressor is maintained at a second stage of the one or more stages and the power supply provided is controlled at the normal power setting to provide the compressor the rated power input and the rated frequency, the second compressor mode setting operating the compressor at a rated heating capacity; and operating the compressor in a third compressor mode setting in response to the signal indicating the climate control system is operating in the heating mode and a third request for heating is received, wherein in the third compressor mode setting the compressor is maintained at the second stage of the one or more stages and the power supply provided is controlled at the overdrive power setting to provide the compressor the modified power input and the increased frequency, the third compressor mode setting operating the compressor at an elevated heating capacity.

15. The method of claim 14, wherein the first stage of the one or more stages is a low stage, and wherein the second stage of the one or more stages is a high stage.

16. The method of claim 14, further comprising:

monitoring an ambient outdoor temperature; and locking out the overdrive power setting based on the ambient outdoor temperature, wherein locking out the overdrive power setting further includes:

receiving a first indication of the ambient outdoor temperature, comparing the first indication of the ambient outdoor temperature to a first threshold condition, and locking out the overdrive power setting based on the first comparison; and the method further comprises enabling the overdrive power setting after the overdrive power setting is locked out, wherein enabling the overdrive power setting includes:

receiving a second indication of the ambient outdoor temperature;

comparing the second indication of the ambient outdoor temperature to a second threshold condition, and enabling the overdrive power setting based on the second comparison.

17. The method of claim 14, further comprising:

monitoring a compressor suction pressure; and locking out the overdrive power setting based on the compressor suction pressure, wherein locking out the overdrive power setting further includes:

receiving a first indication from the compressor suction pressure, comparing the first indication of the compressor suction pressure to a first threshold condition, and locking out the overdrive power setting based on the first comparison; and the method further comprises enabling the overdrive power setting after the overdrive power setting is locked out, wherein enabling the overdrive power setting includes:

receiving a second indication of the compressor suction pressure;

comparing the second indication of the compressor suction pressure to a second threshold condition, and enabling the overdrive power setting based on the second comparison.

* * * * *